US006871605B1

(12) United States Patent
Zesch et al.

(10) Patent No.: US 6,871,605 B1
(45) Date of Patent: Mar. 29, 2005

(54) COMPUTERIZED STITCHING INCLUDING EMBROIDERING

(75) Inventors: Manfred Zesch, Fussach (AT); Peter Kern, Westminster, CO (US); Michael E. Dickeson, Arvada, CO (US); Jurg Henz, Westminster, CO (US); Jeffrey T. Block, Westminster, CO (US); Dale Alan Zoetewey, Denver, CO (US); Victor Justin Rhodes, Denver, CO (US); Dean Gerald Pearson, Arvada, CO (US)

(73) Assignee: Melco Industries, Inc., Denver, CO (US)

( * ) Notice: Subject to any disclaimer, the term of this patent is extended or adjusted under 35 U.S.C. 154(b) by 0 days.

(21) Appl. No.: 10/834,626

(22) Filed: Apr. 28, 2004

Related U.S. Application Data

(62) Division of application No. 10/062,154, filed on Jan. 31, 2002, now Pat. No. 6,823,807.

(51) Int. Cl.[7] ..... D05B 19/12

(52) U.S. Cl. ..... 112/475.01; 112/470.01; 112/278; 112/302

(58) Field of Search ..... 112/470.01, 475.01, 112/475.17, 302, 273, 277, 278, 254, 255

(56) References Cited

U.S. PATENT DOCUMENTS

| | | | | | |
|---|---|---|---|---|---|
| 4,481,507 | A | | 11/1984 | Takiguchi et al. | 112/277 X |
| 4,726,309 | A | | 2/1988 | Popp | 112/313 |
| 4,932,346 | A | * | 6/1990 | Matsubara et al. | 112/278 |
| 4,934,292 | A | | 6/1990 | Mardix et al. | 112/273 |
| 5,072,680 | A | | 12/1991 | Nakashima | 112/445 |
| 5,138,961 | A | * | 8/1992 | Nakano et al. | 112/291 |
| 5,237,944 | A | | 8/1993 | Willenbacher et al. | 112/273 |
| 5,555,827 | A | | 9/1996 | Tanabe | 112/102.5 |
| 5,603,462 | A | | 2/1997 | Conrad et al. | 112/302 X |
| 5,915,316 | A | | 6/1999 | Tajima et al. | 112/470.05 |
| 6,012,405 | A | | 1/2000 | Melton et al. | 112/475.01 |
| 6,161,491 | A | | 12/2000 | Takenoya et al. | 112/102.5 |
| 6,445,970 | B1 | | 9/2002 | Hedman et al. | 700/138 |

OTHER PUBLICATIONS

Toyota Expert 851 Brochure, Pantograms Mfg. Co., Inc, Published 2/98.

Toyota Expert 850–3 Brochure, Pantograms Mfg. Co., Inc., Published 3/98.

TLFD Series Emblaser Brochure, Tokai Industrial Sewing Machine Co., Ltd. , Published 1996.

* cited by examiner

*Primary Examiner*—Peter Nerbun
(74) *Attorney, Agent, or Firm*—Sheridan Ross P.C.

(57) ABSTRACT

A stitching apparatus is disclosed which has at least one active thread feeder and is operable to adjust stitching operation based on the condition of a thread being stitched. The active thread feeder is operable to feed thread from a spool to a needle assembly, where the thread is stitched into fabric. The stitching apparatus includes at least one thread sensor. The thread sensor outputs information related to thread tension, which is received at a control which includes a first controller, and the first controller is used for controlling the thread. The control can calculate a thread feed length, and activate the active thread feeder to feed the appropriate amount of thread to the needle assembly. The control can use information from the thread sensor to adjust thread tension by adjusting the active thread feeder. The control can also detect a break in the thread, or a break in an underthread which is located in a lower arm assembly and is used to lock stitches. The thread sensor is located more adjacent to the thread than to the underthread.

10 Claims, 23 Drawing Sheets

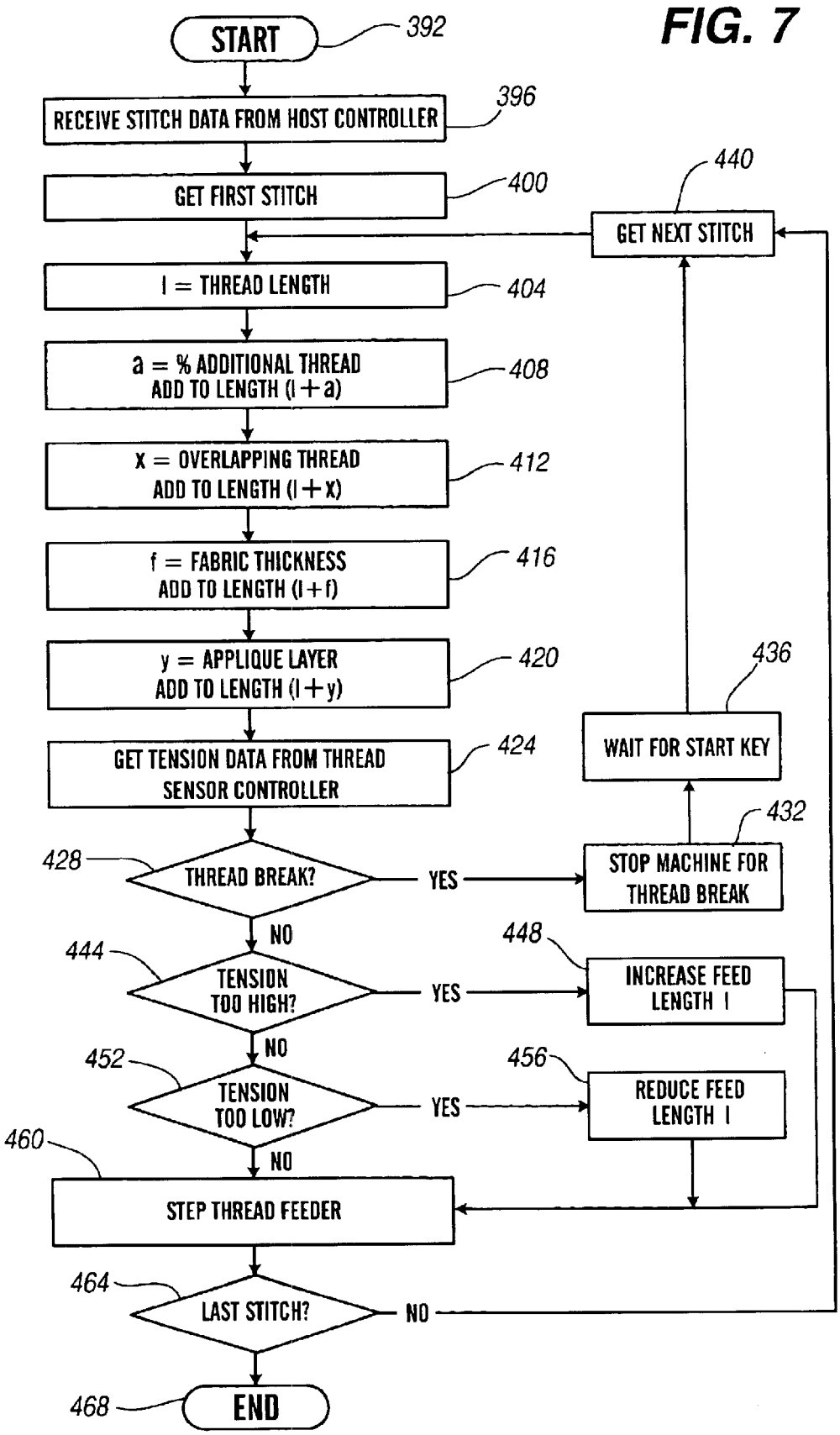
FIG. 7
START
392
RECEIVE STITCH DATA FROM HOST CONTROLLER
396
GET FIRST STITCH
400
GET NEXT STITCH
440
l = THREAD LENGTH
404
a = % ADDITIONAL THREAD ADD TO LENGTH (l + a)
408
x = OVERLAPPING THREAD ADD TO LENGTH (l + x)
412
f = FABRIC THICKNESS ADD TO LENGTH (l + f)
416
y = APPLIQUE LAYER ADD TO LENGTH (l + y)
420
436
WAIT FOR START KEY
GET TENSION DATA FROM THREAD SENSOR CONTROLLER
424
432
428
THREAD BREAK?
YES
STOP MACHINE FOR THREAD BREAK
NO
448
444
TENSION TOO HIGH?
YES
INCREASE FEED LENGTH l
NO
452
456
TENSION TOO LOW?
YES
REDUCE FEED LENGTH l
460
NO
STEP THREAD FEEDER
464
LAST STITCH?
NO
468
END

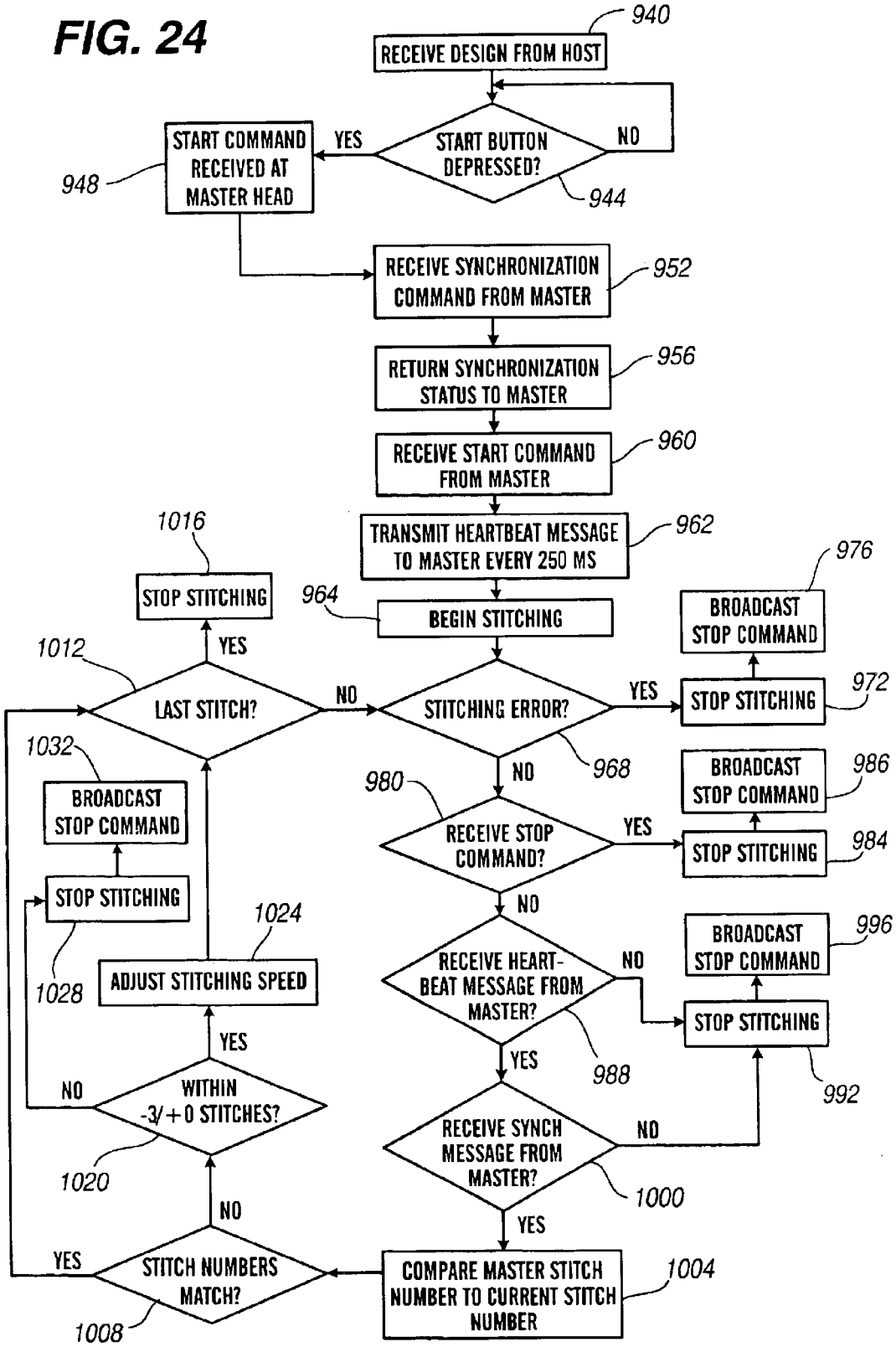
FIG. 24
940
RECEIVE DESIGN FROM HOST
START BUTTON DEPRESSED?
YES
NO
944
START COMMAND RECEIVED AT MASTER HEAD
948
RECEIVE SYNCHRONIZATION COMMAND FROM MASTER
952
RETURN SYNCHRONIZATION STATUS TO MASTER
956
RECEIVE START COMMAND FROM MASTER
960
TRANSMIT HEARTBEAT MESSAGE TO MASTER EVERY 250 MS
962
BEGIN STITCHING
964
STITCHING ERROR?
968
YES
NO
STOP STITCHING
972
BROADCAST STOP COMMAND
976
RECEIVE STOP COMMAND?
980
YES
NO
STOP STITCHING
984
BROADCAST STOP COMMAND
986
RECEIVE HEART-BEAT MESSAGE FROM MASTER?
988
NO
YES
STOP STITCHING
992
BROADCAST STOP COMMAND
996
RECEIVE SYNCH MESSAGE FROM MASTER?
1000
NO
YES
COMPARE MASTER STITCH NUMBER TO CURRENT STITCH NUMBER
1004
STITCH NUMBERS MATCH?
1008
YES
NO
WITHIN -3/+0 STITCHES?
1020
NO
YES
ADJUST STITCHING SPEED
1024
STOP STITCHING
1028
BROADCAST STOP COMMAND
1032
LAST STITCH?
1012
YES
NO
STOP STITCHING
1016

COMPUTERIZED STITCHING INCLUDING EMBROIDERING

This application is a div of Ser. No. 10/062,154 Jan. 31, 2002 U.S. Pat. No. 6,823,807.

FIELD OF THE INVENTION

The present invention relates to stitching machines, and more specifically, to computerized machines capable of stitching programmed designs into garments using multiple thread colors.

BACKGROUND OF THE INVENTION

Stitching systems capable of stitching or embroidering patterns into garments or fabric using multiple colors are common in today's garment industry. In typical stitching machines, a first needle stitches a first color in a preset pattern. If the pattern requires several colors, a second needle stitches a second color in a preset pattern, with this process repeated for several colors until the complete pattern is stitched into the garment. Such stitching or embroidery machines are commonly controlled by a computer system. Typically, an operator downloads a pattern to be stitched to a computer system within the embroidery machine. Included with the pattern are several other parameters, including the size of the pattern to be stitched, and the size of the hoop which will hold the garment while it is being stitched.

Upon receiving the pattern and associated other information, the embroidery machine makes appropriate calculations to, among other things, verify the pattern will fit on the garment or fabric, and that the pattern will not overlap the hoop. After the pattern is downloaded, the computer system makes the appropriate calculations. When the operator has loaded the garment or fabric onto the embroidery machine and made all of the appropriate checks, the operator gives the embroidery machine a command to begin stitching, at which point, the machine begins stitching the pattern into the garment or fabric.

Typical embroidery machines include a sewing head, an X-Y assembly, and a hook and bobbin assembly. The sewing head is commonly a multi-needle head, containing several needles which are used to stitch different thread colors. The sewing head is commonly located on a carriage at the front of the embroidery machine and is movable on the carriage to locate a first needle in a stitching position above the hook and bobbin assembly to stitch a first thread color into the garment. When a second thread color needs to be stitched into the garment, the sewing head is moved on the carriage to locate a second needle in a stitching position above the hook and bobbin assembly to stitch the second thread color into the garment.

When performing stitching operations, the embroidery machine, as is common and well known in the industry, moves the needle containing an upper thread through the garment. There is typically a needle plate located beneath the garment which the needle projects through when it has moved through the garment. Beneath the needle plate is the hook and bobbin assembly. The hook rotates around a lower thread which is fed from the bobbin. The hook rotates to catch the upper thread, and carries the upper thread around the lower thread as the hook rotates. When the hook nears the completion of its revolution, the needle is pulling back through the needle plate and garment, and the upper thread disengages from the hook. When the needle pulls the rest of the way through the garment, the upper thread is pulled around the lower thread and becomes taught, thus securing, or locking, the stitch. The X-Y assembly then moves the garment to an appropriate position for the next stitch, and the process is repeated.

The X-Y assembly is secured to the embroidery machine and is adapted to be connected to a hoop which contains a garment to be stitched. The X-Y assembly contains an X and a Y positioning mechanism which moves the hoop in both the X and Y directions with respect to the embroidery machine. When stitching a pattern, the X-Y assembly moves the hoop in a preset pattern with respect to the stitching needle, and a pattern in thus stitched into the garment.

In such systems, mechanical apparatuses typically pull thread from a spool through a take-up lever and to the needle assembly. The thread is fed through the needle, which, as discussed above, moves in a reciprocating manner to move the needle through the garment and into the hook and bobbin assembly. As described above, when the needle pulls out of the garment, and the stitch is locked, there is tension in the thread which pulls the thread taught and locks the stitch. However, typical systems create more tension than is required to lock the stitch. This extra tension is the result of the mechanical apparatuses that pull the thread from the spool to the needle. Typical embroidery machines, as well as other stitching machines, route thread from the spool to a thread guide, to a take up lever, back through the thread guide, and to the needle. The take up lever is connected to the same mechanical apparatuses which move the needle, and moves up and down with the same frequency.

When the take up lever moves back up, thread is pulled from the hook and bobbin, resulting in the extra thread tension. This extra thread tension may cause the fabric of the garment being stitched to "bunch up." That is, the tension in the thread will create additional tension in the stitches being sewn into the garment and, if the fabric of the garment is a relatively soft material, the stitch may pull the fabric together. In situations where this may happen, it is common to use a backing material to lend additional support, or stiffness, to the garment in order to avoid this bunching up. The backing material is placed on the side of the garment opposite the side that the pattern is stitched on. The increased amount of material required for the backing increases cost, compared to stitching a garment using no backing. Thus, it would be advantageous to reduce the need for backing material. Additionally, the use of backing material also increases the labor required to stitch a pattern into a garment, compared to stitching a garment with no backing. When using backing, an operator must obtain the backing material, and place it into the proper position with respect to the garment being stitched. Additionally, once the pattern is stitched, the backing material may need to be trimmed by an operator. Therefore, the reduction of the need for using backing material would also reduce labor costs related to stitching patterns.

In addition to necessitating the need for backing material as described above, the extra thread tension created by the mechanical apparatuses, which pull thread from the spools to the needle assemblies, may lead to thread breaks, which can interrupt the stitching process. If the embroidery machine has a single sewing head, the stitching operations must be stopped and the thread break corrected. If the embroidery machine has multiple stitching heads, and a thread breaks on one of the stitching heads, it may be more difficult to correct the thread break. This is due to the multiple stitching heads operating synchronously, stitching the same pattern into multiple garments at the same time. When a thread breaks, it typically takes a machine several stitches to detect that the break has occurred. If a thread breaks on a first stitching head, the remaining stitching heads will continue stitching the pattern until the first stitching head stops. Since it is common for embroidery machines with multiple sewing heads to have the sewing heads mechanically coupled, when such a thread break occurs, the remaining sewing heads will be "ahead" of the sewing head which had the thread break. Thus, when a break occurs in such a system, additional steps must be taken to "catch up" the sewing head which had the thread break. Thus, it would be advantageous to reduce the number of thread breaks and to reduce the necessity to back up all the heads in the event of a thread break.

Additionally, in typical machines which employ mechanical apparatuses to pull thread from the spool, the amount of thread pulled from the spool for each stitch may not be consistent, due to geometrical variations which occur from stitch to stitch. This inconsistent amount of thread pulled from the spools results in differing thread tension from stitch to stitch, and may result in inconsistent sew-outs. Inconsistent sew-outs may result in a completed pattern that has less uniformity from stitch to stitch, and may thus reduce the aesthetic appeal of the stitched pattern. Therefore, it would also be beneficial to reduce thread tension and have just the right amount of thread in such a system in order to produce more consistent sew-outs to result in a consistent and visually appealing stitched pattern.

As mentioned above, embroidery systems may encounter thread breaks, where the upper thread being stitched from the spool and needle assembly may break. Additionally, a break may occur in the thread being used to lock the stitch using the bobbin and hook assembly, known as a lower thread break. Thread may break for a number of reasons, including tension in the sewing process, incorrect feeding into the system from the thread spool or bobbin, and binding in the mechanical apparatuses which pull the thread into the needle or hook assembly, to name a few. When performing stitching operations, it is beneficial to have knowledge of any thread breaks as quickly as possible, in order to discontinue the stitching of the pattern and repair the break and return the embroidery system to stitching operations.

Typical systems include sensors to perform the function of detecting thread breaks. Such systems commonly include a thread break monitor to detect upper thread breaks, and an underthread detector to detect breaks in the lower thread. The thread break monitor generally includes a mechanical assembly which detects movement in the upper thread. The thread break monitor is usually located at a position above the take up lever, and sends a signal to control electronics in the embroidery machine if there is no movement in the upper thread. When the control electronics receive a signal that the upper thread is not moving as expected, this indicates a problem with the sewing process such as a thread break, and the control electronics act to halt the stitching operations of the embroidery system. Likewise, the underthread detector is generally located in a position close to the hook and bobbin assembly, and includes a mechanical or optical apparatus to detect movement in the lower thread, and sends a signal to the control electronics in the event that the lower thread stops moving.

When the embroidery system halts stitching operations after a problem, such as a thread break, in the upper or lower thread, is detected, an operator may then repair the break and resume stitching operations. In such a system, it is beneficial to detect the thread break quickly in order to repair the break and resume operations with as little down time as possible. Such systems typically detect a break in the upper or lower thread within several stitch cycles of the break, with a typical number of stitches being five.

While current sensors for detecting thread breaks are adequate for detecting such breaks, they commonly have problems associated with them. In particular, underthread detectors can be problematic during operations of an embroidery system. As mentioned above, underthread detectors in typical embroidery systems are located in close proximity to the hook and bobbin assembly, and are mechanical or optical apparatuses which detect the break in the thread by sensing mechanical movement. Because of their location beneath the garment being stitched, it is common for debris to accumulate in or around the underthread detector. This may result in the underthread detector malfunctioning, and giving false readings of thread breaks or not detecting a thread break. In such a case, the underthread detector requires cleaning, or in certain cases, replacement. In addition to debris, lubricant from the mechanical apparatuses may also accumulate in and around the underthread detector, resulting in the sensor associated with the underthread detector malfunctioning, which can also result in the underthread detector having to be cleaned or replaced. Therefore, it would be advantageous to have a robust sensor which can detect breaks in the underthread with at least the same sensitivity as current underthread detectors, while also requiring less maintenance due to collected debris and lubricant in and around current underthread detectors.

In addition to the inadequacies of current underthread detectors, upper thread break sensors also have several problems commonly associated with them. One such problem is the location of the sensor. As mentioned above, upper thread break sensors are typically located above the take up lever on the embroidery system, and can often take several stitches to detect a thread break. Since it is advantageous to detect a thread break as quickly as possible, it would be advantageous to have a thread break detector which is closer to the needle, and can detect thread breaks relatively quickly.

As mentioned above, when a needle moves the upper thread into the garment when stitching, the bobbin and hook assembly lock the stitch by looping the lower thread around the upper thread prior to the needle lifting out of the garment. In order to prevent the garment from lifting from the needle plate, and to more securely lock a stitch, a presser foot is lowered to the garment surface to secure the garment during the stitching. The presser foot helps ensure that the stitch is properly locked and the tension in the thread is consistent from stitch to stitch.

In order to perform optimally, a presser foot must contact the garment surface when the needle lifts out of the garment. If the presser foot does not contact the garment surface, the garment may lift from the needle plate when the needle lifts through the garment, thus creating the potential for inconsistent sew-outs. Alternatively, if the garment is made of a relatively thick fabric, the presser foot may strike the garment with a relatively high force, creating a relatively loud audible sound, and causing mechanical stress in the presser foot, reducing its life-time. Thus, it is important to properly adjust the height of the presser foot such that it contacts the garment surface, yet does not contact with a force high enough to create a loud audible sound and/or mechanical stress. The loud audible sound is not desirable because, among other reasons, it is typically preferred that embroidery machines operate with as little noise as possible. Low noise operation is desirable especially when several embroidery machines are located in the same room, because additional noise may result in difficulty for people around the machines hearing other people or audible alarms. Thus, it is advantageous to have an adjustable presser foot, allowing proper force to be applied to garments of different thicknesses during stitching, as well as reducing noise level resulting from operation of the machine.

In typical current day machines, the presser foot is adjustable by manually adjusting a mechanical linkage connecting the presser foot to the needle drive assembly. This adjustment is typically done by removing safety covering associated with the needle drive and making an adjustment to the mechanical linkage to adjust the presser foot height. The safety cover is then replaced, and the embroidery machine operated. The operator then observes the operation of the machine to verify the presser foot is properly adjusted. If the presser foot is not properly adjusted, the adjustment process is repeated until the presser foot height is correct. As can be seen, this can be a laborious and time consuming process. As a result, many times the presser foot is improperly adjusted, or not adjusted at all. The presser foot may be improperly adjusted because an operator may make a first adjustment, and not make any additional adjustments to further fine tune the presser foot height, due to the burden of the adjustment process. In certain cases, the presser foot may not be adjusted at all, due to the burden of the adjustment process. Therefore, it would be advantageous to have a presser foot which is easily adjustable and can be adjusted without removing safety covering from the machine. Furthermore, it would be advantageous to make presser foot adjustments while the machine is operating, thus allowing for fine tuning of the presser foot height without interrupting stitching operations of the machine.

As mentioned above, a garment is placed in a hoop or other apparatus in order to secure the garment to the embroidery machine and to properly move the garment beneath the stitching head in order to stitch a pattern into the garment. Additionally, as also mentioned above, hoops of varying size may be used, depending upon the pattern and the garment that is being stitched. When a garment is placed in this hoop and secured to the X-Y assembly of the embroidery machine, it is important to ensure that the needle will not hit the hoop. If the needle hits the hoop, it can damage the needle and result in the embroidery machine being inoperable and needing repair. This results in downtime for the machine, as well as the cost of the replacement parts and labor to install the replacement parts.

Additionally, in many situations, it is beneficial for an operator to visually verify the location at which a needle will penetrate the garment. For example, when a garment is initially placed onto an embroidery machine, the starting location of the pattern is set in order to ensure the pattern is stitched at the proper location on the garment. Such a situation can also arise when an applique is stitched into a pattern. When the applique is to be set on the garment being stitched, the location of the stitch is determined in order to verify that the applique will be properly secured to the garment. Also, in the event of a thread break, once the thread break is corrected, the machine must be placed in the position to resume stitching from the point of the thread break. Typically, machines can be backed up a certain number of stitches, and the location verified, and stitching operations continued.

In typical embroidery machines, the control system includes software which verifies that the needle will not contact the hoop. This software receives information regarding the hoop size, and compares the pattern to be stitched to the hoop size to verify that no stitching will occur at or beyond the edge of the hoop. However, occasionally the hoop size entered into the software is not correct or the position of the pattern relative to the hoop is offset. In such a case, if the hoop actually placed onto the embroidery machine is smaller than the hoop that the control system thinks is there or if the pattern is offset, the needle may contact the hoop and cause damage. Accordingly, it is common for an operator to visually verify that the needle will not contact the hoop. In typical current day machines, this is commonly done by the operator pulling a needle down from the needle case to a location just above the garment, without actually contacting the garment. The embroidery machine is then commanded to trace an outline of the pattern to be stitched, and the operator visually verifies that the needle will not hit the hoop at any point of the pattern.

In situations where an operator needs to verify the starting location of a stitch, a similar procedure is used. Typically, an operator will pull a needle down from the needle case to a point just above the garment to be stitched. With the needle in this position, the location of the garment is adjusted until the proper starting location is located beneath the needle. Once the proper starting location is located beneath the needle, the needle is pushed back into the needle case, and stitching operations are started.

While the above-mentioned procedures are useful in verifying that a needle will not hit a hoop, and the starting location of a stitch, they have several drawbacks. One such drawback for using such a procedure to verify that a needle will not hit the hoop is that often the needle is pulled down far enough that, if the pattern does overlap the hoop, the hoop will contact the needle during the tracing procedure described above. In such a situation, an operator either has to stop the tracing, or push the needle out of the way, to prevent the needle from being damaged by hitting the hoop. Thus, if an incorrect hoop is on the embroidery machine, a needle may still be damaged even using the visual verification described above. Also, if a needle is pulled down too far, the garment may be damaged.

Additionally, there are safety concerns with the procedures described above. Namely, an operator may be injured in the process of pulling a needle down from the needle case, or pushing the needle back into the needle case. Accordingly, it would be advantageous to verify the needle will not hit the hoop, and to verify the starting location of a stitch without an operator having to physically pull a needle down from the needle case to a point close to the garment. Furthermore, it would be beneficial to reduce the possibility of a garment being damaged during tracing by a needle that is pulled down.

As mentioned above, if mass producing garments it is beneficial to be able to stitch the same pattern into multiple garments. Such a situation is common, for example, when stitching logos into clothing. In such a case, it is useful to have several stitching heads operating simultaneously in order to increase production of such garments. It is also useful to use as few operators in such operations as possible, to reduce labor costs associated with stitching the patterns into the garments. One common method for achieving both of these objectives is to have multiple stitching heads which operate simultaneously to stitch patterns into multiple garments. Such machines typically are controlled at a single location by an operator after loading garments into each stitching head location. Many of these machines have stitching heads which are mechanically coupled to one another. In such a case, all of the stitching heads have to be used, due to the mechanical coupling of the stitching heads.

Additionally, these type of machines generally have a fixed number of heads, and if additional capacity is desired, an entire new machine must be purchased, often at considerable expense. Thus, it would be advantageous to have a machine which is capable of adding stitching heads incrementally, thereby allowing incremental capacity increases without as significant of a capital expense. Furthermore, it would be advantageous to, in certain circumstances, allow for fewer than all of the stitching heads on such a machine to be used, thus allowing for the stitching of a single or very few garments on such a machine.

Accordingly, there is a need for a stitching machine which overcomes the foregoing drawbacks found in prior art machines and meets the aforementioned needs.

SUMMARY OF THE INVENTION

In accordance with the present invention, a stitching apparatus is disclosed which has a minimum of one thread, and one thread sensor. The thread sensor outputs information related to thread tension, which is received at a control which includes a first controller, and the first controller is used for controlling the thread. The thread is operably associated with an active thread feeder, which is activated by a motor. The active thread feeder includes at least one gear that is associated with the motor.

The stitching apparatus may include a number of different threads, and associated active thread feeders. In this embodiment, one of the active thread feeders, and associated thread, is associated with the motor at a particular time. When a different thread needs to be stitched, the active thread feeder associated with that thread is moved such that it is associated with the motor. The first controller is used to control the activation of the motor, and thus the active thread feeder which is associated with the motor.

In one embodiment, the active thread feeders have an associated first gear, which couples with the gear associated with the motor. Each active thread feeder has an associated aligner. The aligner engages the first gear such that the first gear is located in a predetermined location with respect to the motor.

In one embodiment, the stitching apparatus includes first and second thread sensors.

The stitching apparatus includes an upper thread and a lower thread, with the thread sensors disposed more adjacent to the upper thread than to the lower thread. In one embodiment, the control obtains and stores a tension profile based on information related to thread tension. The control determines tension data using the tension profile and reference information.

In another embodiment, the stitching apparatus includes a thread sensor controller, and the thread sensor is associated with a thread break detection circuit, which is operatively associated with the first controller. The thread tension information is used to determine whether a thread break is present, and whether the thread break is in an upper thread or a lower thread. The thread and thread sensor is operatively associated with a thread contact element that moves based on thread tension.

In one embodiment, the control also determines a feed length for at least a first stitch. The feed length can be based on one or more of the following: stitch angle, stitch length, and the number of stitches crossed. The control in this embodiment also includes a host controller in communication with a main controller. The host controller determines an additional thread length and the number of stitches crossed. The control can also add additional thread length based on at least one of the following: overlapping thread, thickness of fabric, and an applique layer. The thread length information can then be used in activating the active thread feeder.

The invention also includes a method for stitching using a stitching apparatus. The method includes determining information related to a first stitch to be stitched using the stitching apparatus, obtaining tension data, and controlling the stitching of the first stitch using the tension data. The determining step can include providing first stitch data, a first stitch angle, and a first stitch length, and calculating a feed length using the first stitch angle and first stitch length. The determining step can also include calculating the number of stitches crossed by the first stitch, as well as calculating additional thread using the number of stitches crossed by the first stitch and a nominal stitch length. The determining step can also include adding additional thread to a thread length associated with the first stitch, adding overlapping thread to the thread length, and adding a fabric and/or applique thickness to the thread length.

The obtaining step can include acquiring data related to a tension profile using at least a first thread sensor that detects movement which is caused by changing thread tension. In one embodiment, the obtaining step includes checking whether a stitching cycle is completed, and processing data related to a tension profile when the stitching cycle is completed. The data related to a tension profile may be obtained using the first sensor, and tension data may be ascertained using the data related to a tension profile and reference data.

The controlling step, in one embodiment, includes controlling feed length related to the first stitch using tension data. The controlling step can include one of increasing feed length associated with the first stitch and decreasing feed length associated with the first stitch based on the tension data. In one embodiment, an active thread feeder is controlled by the controlling step. A position of the active thread feeder can be controlled, and a motor can be activated which drives the active thread feeder. The controlling step may also include aligning an active thread feeder to be responsive to activation of the motor.

The invention, in one embodiment, also includes a method for stitching using a stitching apparatus which includes determining information related to at least a first stitch to be stitched using said stitching apparatus, the determining step including providing a number related to stitches crossed by the first stitch, and stitching the first stitch using the information. The stitching step utilizes tension data obtained from at least one thread sensor that monitors profile data related to thread-tension. The stitching step includes relying on a comparison of the profile data and reference data. The information may relate to a thread length associated with the first stitch.

In another embodiment, a method is provided for stitching using a stitching apparatus, the method comprising providing a plurality of active thread feeders including at least first and second active thread feeders, causing activation of the first active thread feeder related to stitching a first stitch, and discontinuing activation of the first active thread feeder during a stitching cycle associated with the first stitch. The method may also include moving the first active thread feeder relative to a motor that is used in conducting the causing step, and locating the first active thread feeder away from the motor and positioning the second active thread feeder for activation using the motor.

In yet another embodiment, the invention provides a method for stitching using a stitching apparatus which includes providing a plurality of active thread feeders including a first and a second active thread feeder and a motor that selectively causes activation of one of the first and second thread feeders. The method includes positioning the first active thread feeder relative to the motor, causing activation of the first active thread feeder, moving the second active thread feeder relative to the motor, and causing activation of the second active thread feeder using the motor. When causing activation of the first thread feeder, the stitching apparatus may be stitching at least a first stitch during a first stitching cycle and discontinuing the causing step at least during some time during the first stitching cycle.

In still a further embodiment, the invention provides a method for detecting a thread break during operation of a stitching apparatus, the method comprising monitoring thread, including upper thread and lower thread using a first sensor, and using the first sensor when ascertaining a thread break of the upper thread and using the first sensor when ascertaining a thread break of the lower thread. The ascertaining step may include one of the following: determining that the thread break is due to the upper thread when a first signal amplitude is presented and determining that the thread break is due to the lower thread when a second signal amplitude is present. The monitoring step may include detecting movement using the first sensor. The detecting step may include detecting movement of a contact element that moves depending upon thread tension. The monitoring step may include detecting movement using the first sensor that is located more adjacent to the upper thread than the lower thread.

Based on the foregoing, several benefits of the present invention are readily seen. The invention provides an apparatus which is capable of performing stitching operations with reduced thread tension, which can reduce thread breaks and reduce the need for backing material. The apparatus provides thread break detection using a thread break monitor which is not required to be placed in the lower arm of the apparatus. The invention provides a method for stitching which calculates an amount of thread to feed using an active thread feeder, and provides control to an active thread feeder based on tension present in the thread.

Additional advantages of the present invention will become readily apparent from the following discussion, particularly when taken together with the accompanying drawings.

BRIEF DESCRIPTION OF THE DRAWINGS

FIG. 7 is a flow chart illustrating the operational steps of a main controller of one embodiment of the present invention;

FIG. 24 is a flow chart illustration of the operational steps for stitching a design using a slave head of one embodiment of the present invention.

DETAILED DESCRIPTION

Figure 1:
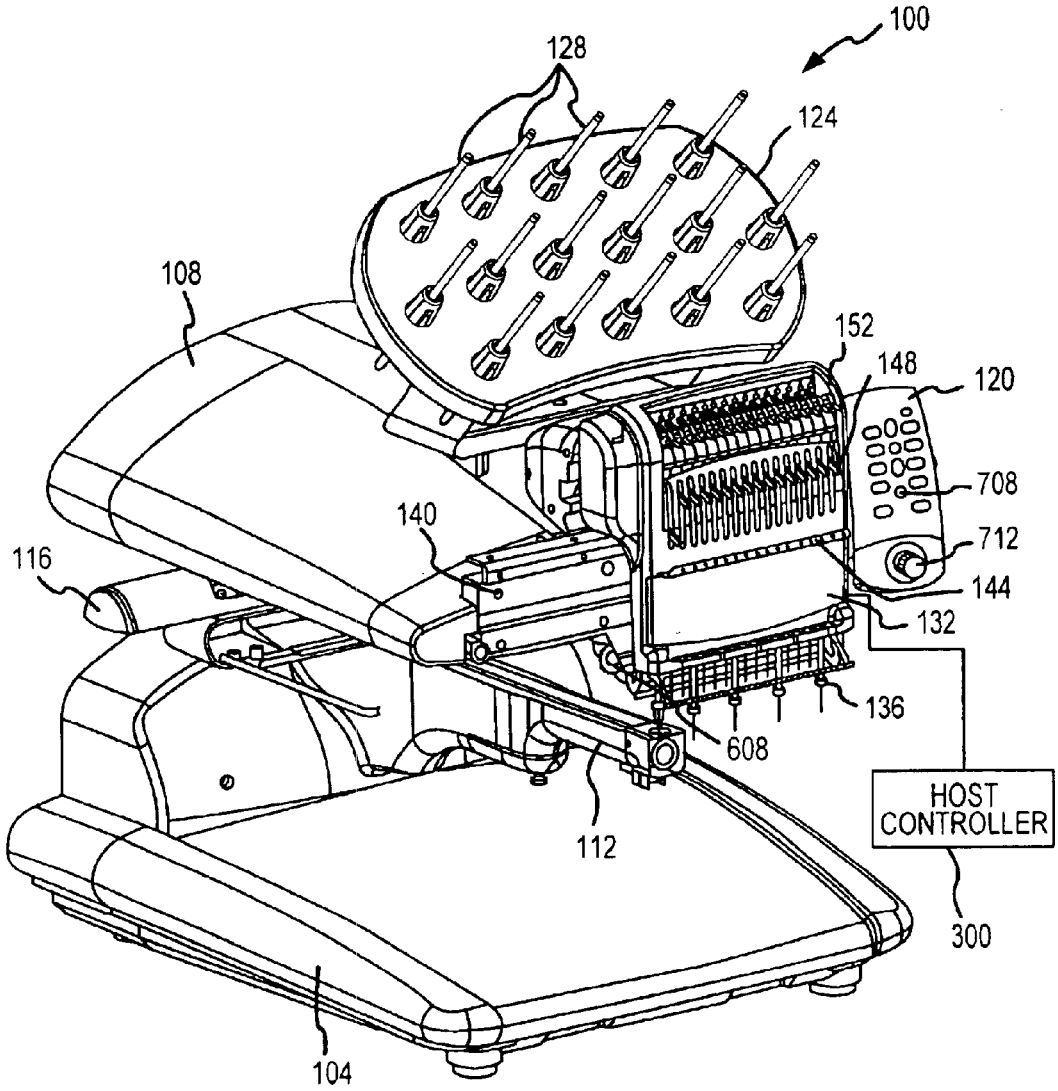
FIG. 1 is a perspective illustration of one embodiment of an embroidery machine of the present invention.

Referring to FIG. 1, a front perspective representation of one embodiment of the invention is now described. The embroidery machine 100 has a base assembly 104, an upper arm assembly 108 mounted to the base assembly 104, a lower arm assembly 112 mounted to the base assembly 104, and an X-Y drive assembly 116 mounted to the base assembly 104. Within the base assembly 104 is a main controller (not shown), which receives patterns to be stitched into a garment from a host controller 300, receives manual commands from a user interface 120, and controls stitching operations. The host controller 300 is a computer which allows a user to input, select, and download design patterns to the main controller. The host controller 300 may be any suitable computer for a user interface, including a Windows based PC, an Apple Macintosh type computer, a UNIX based computer, or any other similar computer capable of providing a user interface and input, selection, and download capabilities.

Mounted to the upper arm assembly 108 is the user interface 120, and a thread tree 124. The thread tree 124 includes spool attachments 128 for sixteen (16) spools of thread. The user interface 120 is a control interface which a user may use to manually operate the embroidery machine 100. A needle case 132 is also attached to the upper arm assembly 108, which has sixteen (16) needles 136. The needle case 132 is attached to a rail 140, and moves along the rail 140 to position a particular needle 136 in proper location to perform stitching operations. A thread guide plate 144 is mounted on the needle case 132. Each needle 136 in the needle case 132 has an associated take up lever 148, and a thread feeder assembly 152.

In operation, a hoop (not shown) is mounted to the X-Y drive assembly 116. Affixed to the hoop is a garment or fabric, into which a pattern is to be stitched. The X-Y assembly 116 operates to move the hoop beneath the needle 136 which is performing stitching operations. The needle 136 stitches the upper thread into the garment, with the stitches being locked into place using the lower thread in the hook and bobbin assembly, as described above. When referring to the upper thread, reference is to the thread which is being stitched into the garment, and when referring to the lower thread, or underthread, reference is to the thread which comes from the bobbin assembly and is used to lock the stitches.

Figure 2:
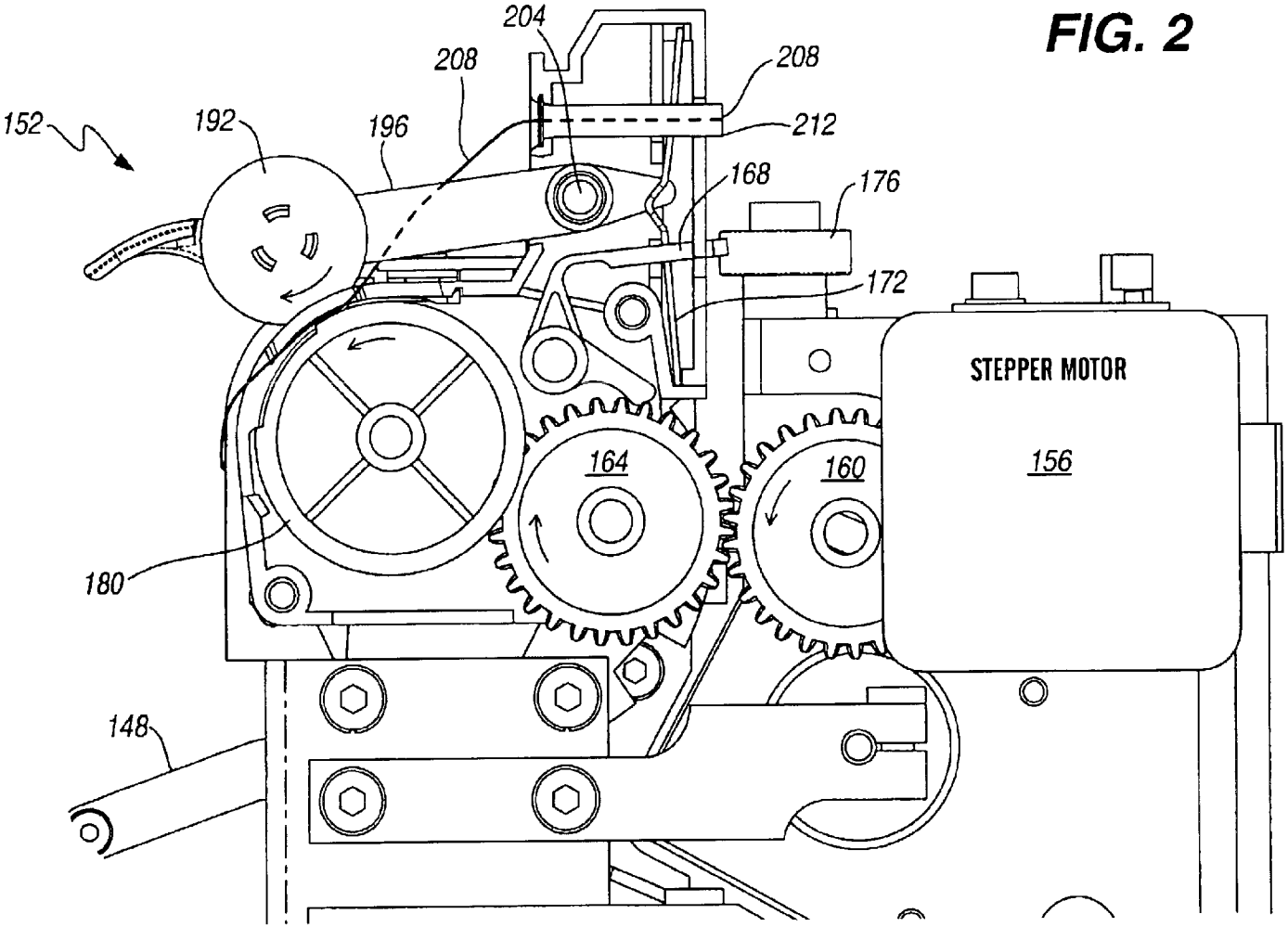
FIG. 2 is a schematic representation illustrating a thread feeder apparatus of one embodiment of the present invention.
Figure 3:
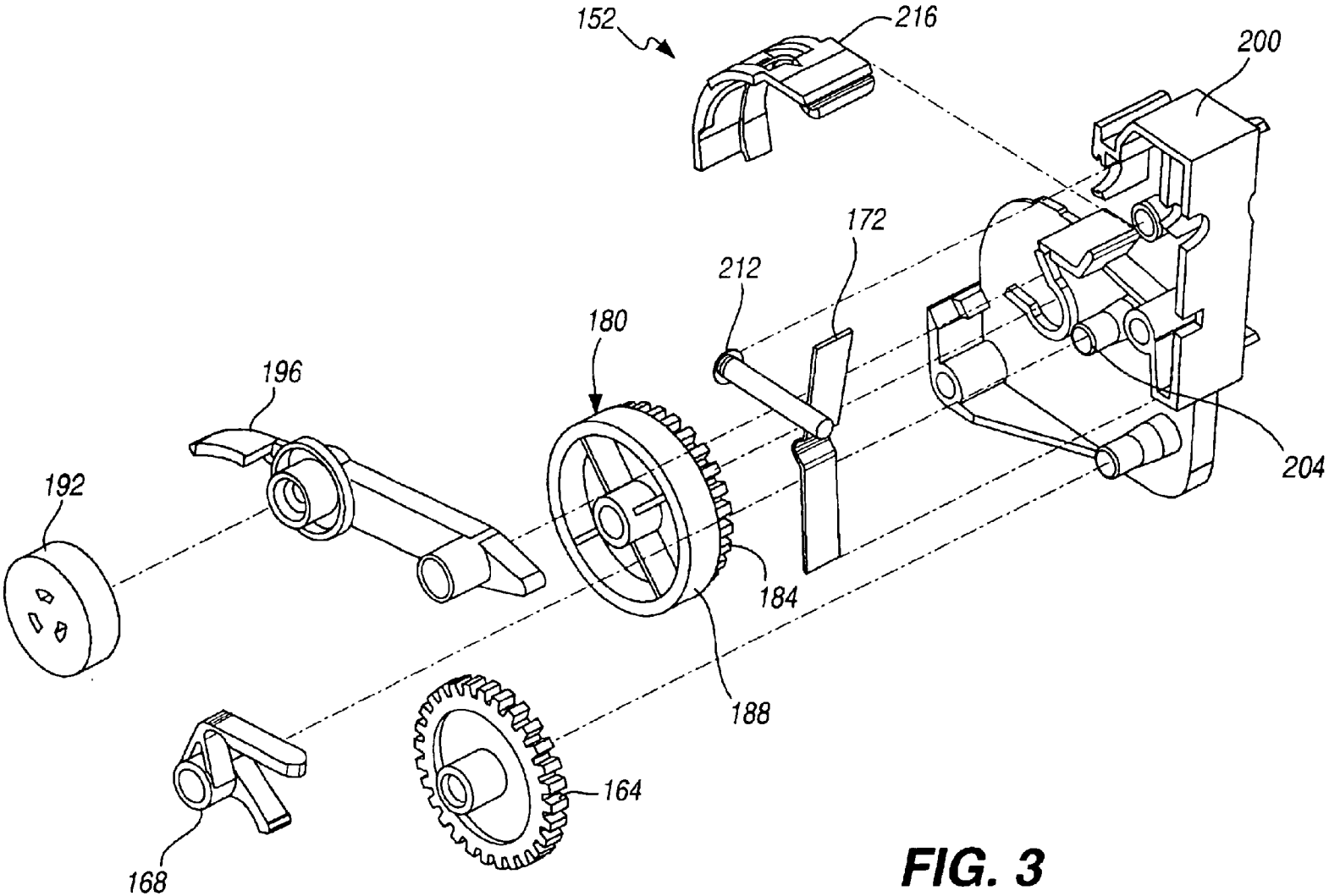
FIG. 3 is an exploded perspective view of a thread feeder apparatus of one embodiment of the present invention.

Referring now to FIGS. 1–3, a thread feeder assembly 152 is now described in more detail. As illustrated in FIG. 2, the thread feeder assembly 152 for a particular needle 136 is positioned adjacent to a stepper motor 156, which drives the thread feeder assembly 152. The needle case 132 is moved on the rail 140 in order to place a particular needle 136 in a stitching position above the lower arm 112. Thus, when a particular color needs to be stitched, the needle 136 associated with that color is positioned such that the thread feeder assembly 152 associated with the needle 136 will be driven by the stepper motor 156. The stepper motor 156 drives a driving gear 160, which is engaged with a thread feed gear 164.

The driving gear 160 is associated with the stepper motor 156, and does not move when the needle case 132 moves along the rail 140. The thread feed gear 164 is associated with the thread feeder assembly 152, and moves to engage the driving gear 160, and thus drive the thread feeder assembly 152.

In order to ensure that the thread feed gear 164 aligns properly with the driving gear 160 when the needle case 132 is moved relative to the stepper motor 156, a clicker 168 is used to engage the teeth of the thread feed gear 164. The clicker 168 is positioned next to a leaf spring 172. The end of the clicker 168 engages the thread feed gear 164 and settles into a gap between the teeth of the thread feed gear 164, resulting in the individual teeth on the thread feed gear 164 being in a preset, and known, position with respect to the needle case 132. The stepper motor 156 can then be adjusted such that the driving gear 160 is in a preset position when the needle case 132 is moved with respect to the upper arm assembly 108. In this way, the teeth on the thread feed gear 164 have minimal contact with the teeth of the driving gear 160 when the needle case 132 is moved to locate a different thread feeder assembly 152 adjacent to the stepper motor 156. Prior to driving the thread feeder assembly 152, an actuator 176 associated with the stepper motor 156 is actuated to move a top portion of the clicker 168. By moving the top portion of the clicker 168, the bottom portion of the clicker 168 does not contact the thread feed gear 164 when it is rotating, thus rotation of the thread feed gear 164 is not restricted by contact with the clicker 168, and the noise associated with operating the embroidery machine 100 is reduced compared to a situation where the clicker 168 would be in contact with the thread feed gear 164 when it is rotating.

The thread feed gear 164 engages a roller 180, which has a gear portion 184 and a flat portion 188, as can be seen in the exploded perspective illustration of FIG. 3. In one embodiment the flat portion 188 of the roller 180 is covered with a relatively high friction material, such as rubber. A pinch roller 192 engages the roller 180. In one embodiment, the pinch roller 192 is also covered with a relatively high friction coating, such as rubber, which engages in a frictional arrangement with the coating on the flat portion 188 of the roller 180, thus when the roller 180 rotates, the pinch roller 192 also rotates. The pinch roller 192 is rotatably mounted to a thread feeder arm 196 which is connected to a thread feeder base 200 at a pivot 204. The leaf spring 172 engages the thread feeder arm 196 and applies pressure to the pinch roller 192 against the roller 180. An upper thread 208, which is fed from a spool on the thread tree 124 is routed through a thread feeder eyelet 212, and between the pinch roller 192 and roller 180. When the stepper motor 156 is activated, the driving gear 160 rotates, resulting in a rotation in the thread feed gear 164, which rotates the roller 180 and associated pinch roller 192, causing the upper thread 208 to be pulled through the thread feeder eyelet 212 and to the take up lever 148. Finally, as can be seen in FIG. 3, a gear cover 216 is fitted over the area of the thread feeder assembly 152 leaving only the flat portion 188 of the roller 180 exposed through an opening in the gear cover 216. This helps prevent the upper thread 208 from becoming caught up in the thread feed assembly 152.

The amount of upper thread 208 fed through the thread feeder assembly 152 can be controlled by the activation of the stepper motor 156. By feeding a predetermined amount of upper thread 208 through the thread feeder assembly 152, tension in the upper thread 208 can be reduced and/or otherwise controlled, compared to a system which relies on mechanical movement of the needle and take up lever to pull the thread from a spool to the needle. In one embodiment, now described with reference to FIGS. 4 through 8, the amount of upper thread 208 fed by the thread feeder assembly 152 is determined according to a preset method.

Figure 4:
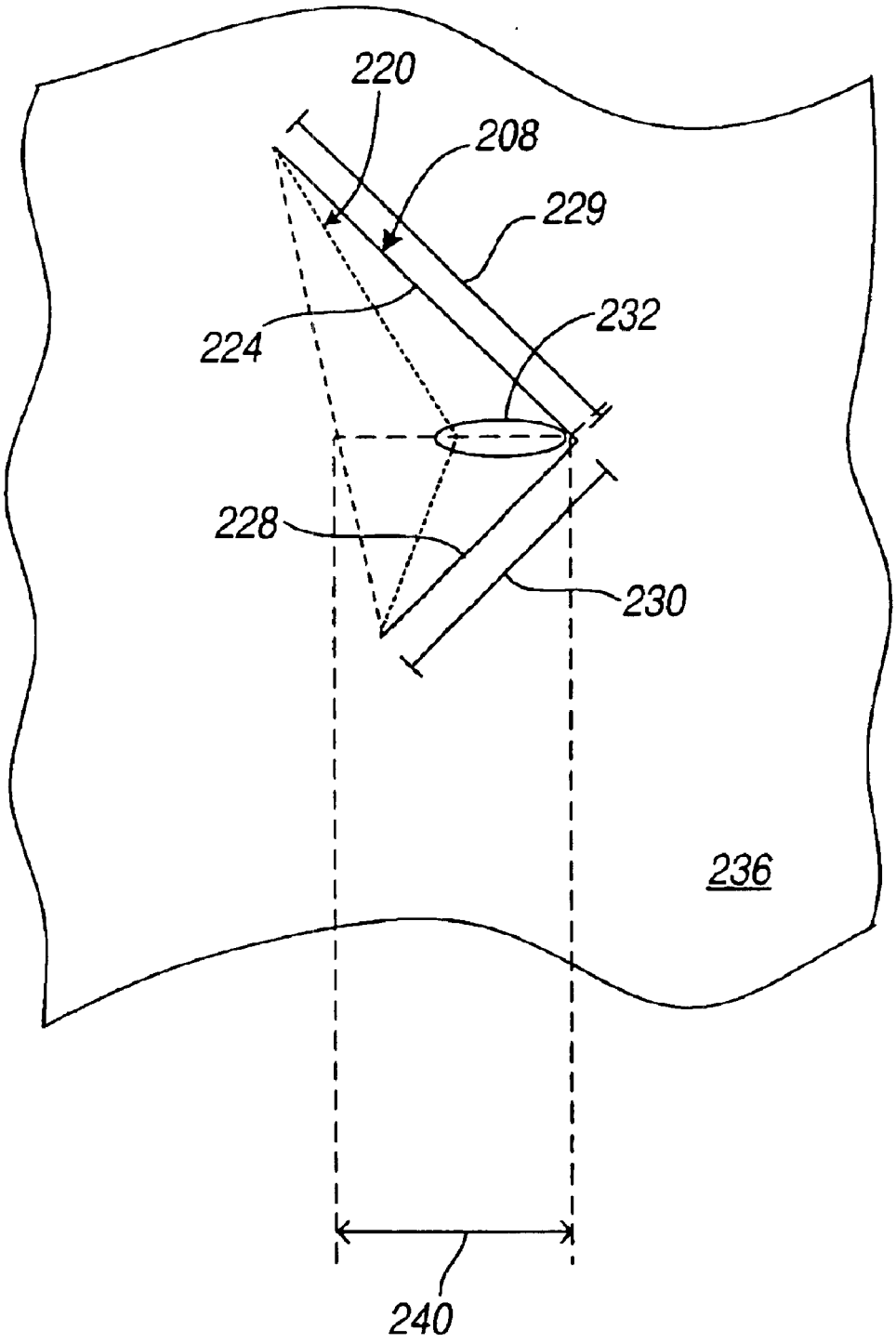
FIG. 4 is an illustration of two thread stitches and relative thread lengths associated with stitches.

With reference now to FIG. 4, an illustration of two stitches and associated thread length is now described. As is known in the art, the length of upper thread 208 needed for a stitch depends upon several factors. The length of the stitch, the angle between the prior stitch and the current stitch, and the thickness of the fabric being stitched are significant factors. In FIG. 4, the upper thread 208 is represented by a solid line, and the lower thread 220 is represented by a dashed line. A first stitch 224 and a second stitch 228 are illustrated in FIG. 4. The first stitch 224 has a nominal stitch length 229, and the second stitch 228 has a nominal stitch length 230. As described above, the lower thread 220 locks the stitch by connecting to a loop 232 in the upper thread 208. When the upper thread 208 penetrates the fabric 236, a hook engages the upper thread 208, and rotates the upper thread 208 around the lower thread 220, and then the needle 136 pulls the upper thread 208 back through the fabric 236, and the stitch is locked. In calculating total thread length to feed from the thread feeder assembly 152, the length of the loop 232 around the lower thread 220 must be factored into the total thread length. The loop thread length 240 for the second stitch 228 is determined by the length of a line bisecting the angle between the first stitch 224 and second stitch 228 that goes from the intersection of the first stitch 224 and second stitch 228 and a line between the ends of the two stitches. The total thread length for the second stitch 228 dispensed by the thread feeder assembly 152 is the sum of the nominal stitch length 230, the loop thread length 240, a material thickness factor, an applique layer thickness factor, a length of any required overlapping thread, an additional thread factor to compensate for any stitches that are crossed with the second stitch 228, and a user defined additional percentage.

Figure 5:
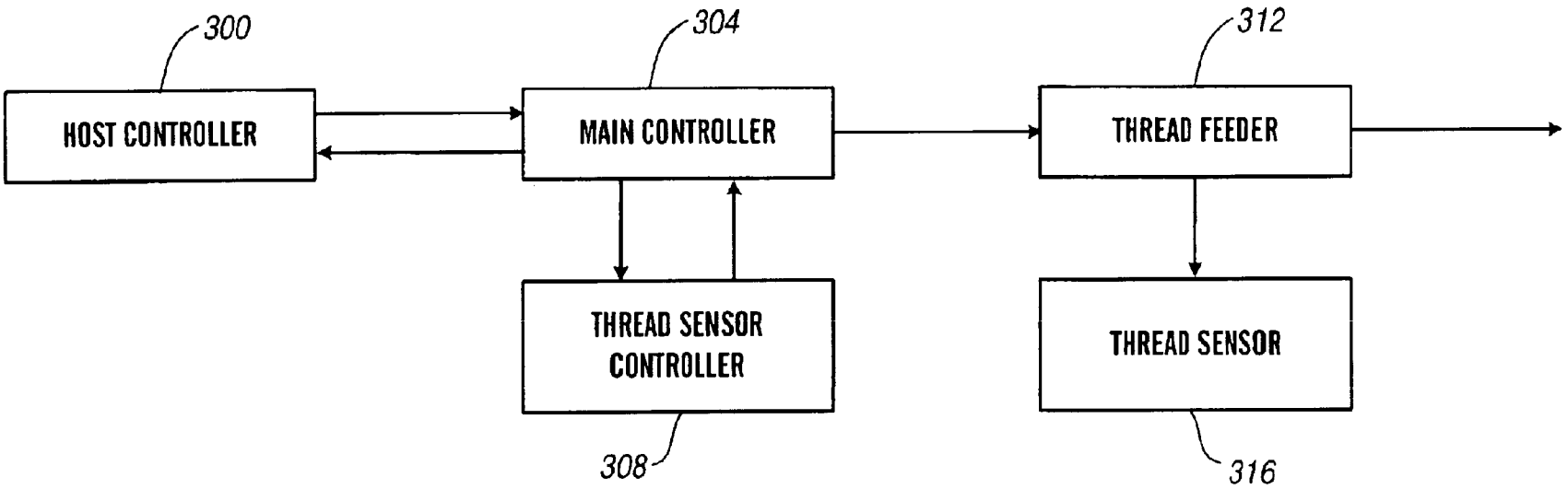
FIG. 5 is a block diagram illustration of the control electronics of one embodiment of the present invention.

Referring now to the block diagram illustration of FIG. 5, the electronics associated with the thread feeder are now described. In the embodiment of FIG. 5, the embroidery machine includes a host controller 300, a main controller 304, and a thread sensor controller 308. The host controller 300, in this embodiment, controls the design and stitching functions. The main controller 304 in this embodiment, communicates with the host controller 300, the thread sensor controller 308, and a thread feeder 312. The thread sensor controller 308 communicates with the main controller 304, and receives information from a thread sensor 316. The operation of the host controller 300, the main controller 304, and the thread sensor controller 308 will be described in more detail with reference to the flow chart illustrations of FIGS. 6–8.

Figure 6:
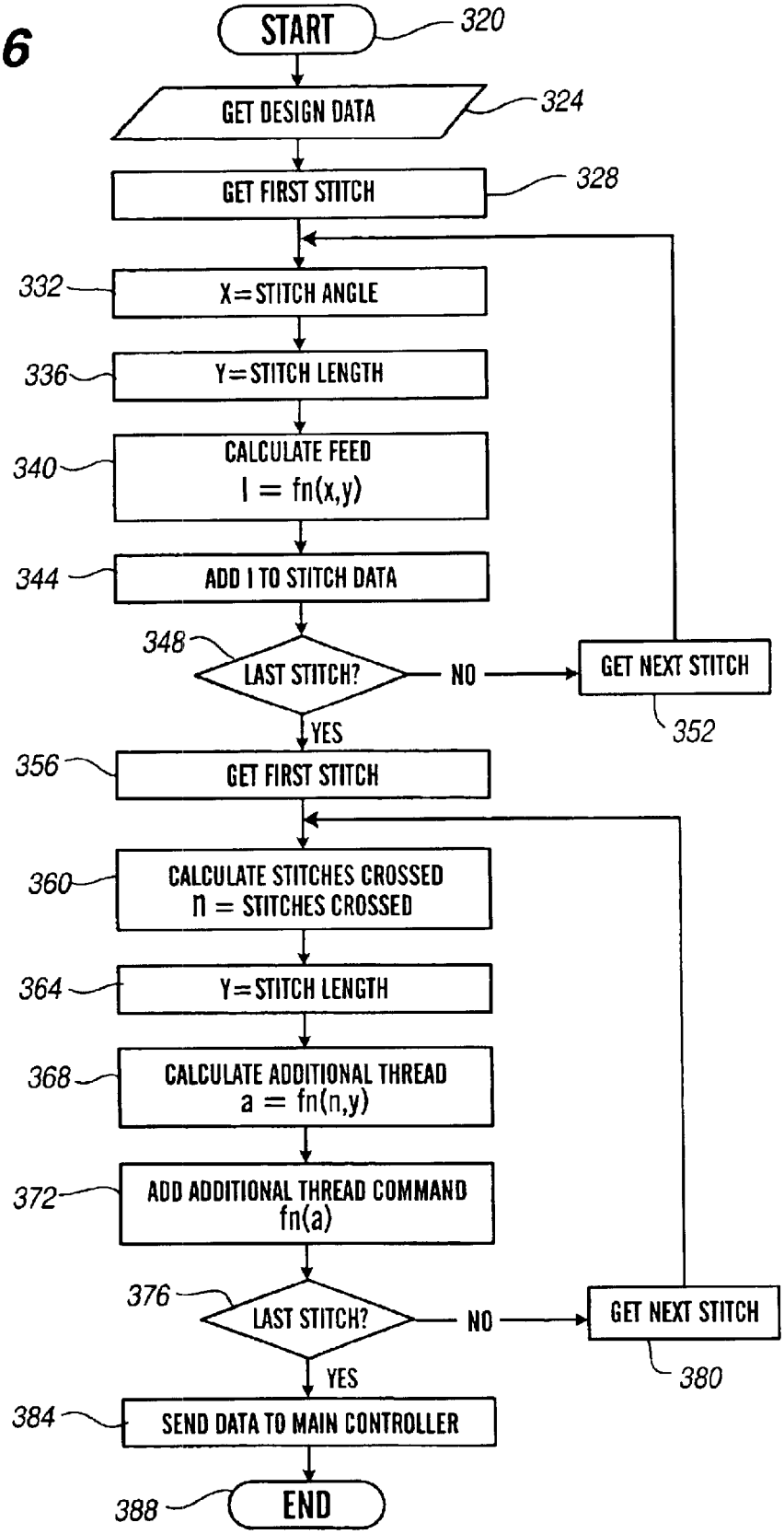
FIG. 6 is a flow chart illustrating the operational steps of a host controller of one embodiment of the present invention.

Referring now to the flow chart illustration of FIG. 6, the thread feed preprocessing operation of the host controller 300 are now described. Initially, as noted by block 320, the host controller 300 receives a start command. Upon receiving the start command, the host controller 300 retrieves design data which is associated with the pattern to be stitched, as noted by block 324. The design data can come from a number of sources, including a disk drive, and a network connection, as will be described in more detail below. The host controller 300 gets the first stitch information from the design data, as noted by block 328. The host controller 300, as indicated by block 332, sets a variable (x), that is associated with the stitch angle. The host controller 300, according to block 336, sets a second variable (y), that is associated with the nominal stitch length. The host controller 300 calculates the loop thread length 240, which as described above is a function of the stitch angle and stitch length, as noted by block 340. The host controller 300 adds the loop thread length to stitch data, as noted by block 344.

The host controller 300, at block 348, determines if the stitch is the last stitch. If the stitch is not the last stitch, the host controller 300 retrieves data for the next stitch, as noted by block 352. The host controller 300 then repeats the operations associated with blocks 332 through 348. If, at block 348, the host controller 300 determines that the stitch is the last stitch, the host controller 300 then gets data for the first stitch, as noted by block 356. The host controller 300 then calculates the number of stitches crossed by the stitch, and assigns the number to a variable (n), as noted by block 360. The host controller 300, at block 364, sets the stitch length variable (y), to the nominal stitch length. The host controller 300 then calculates additional thread length (a) which is a function of stitch length and stitches crossed, as noted by block 368. The host controller 300, according to block 372, adds additional thread length to the existing thread feed length. The thread feed length, at this point, is the sum of the nominal thread length, the loop thread length, and the additional thread length.

The host controller 300, then determines if the current stitch is the last stitch, as indicated by block 376. If the stitch is not the last stitch, the host controller 300 retrieves the next stitch, as noted by block 380. The host controller 300 then repeats the operations associated with blocks 360 through 376 for the next stitch. If, at block 376, the host controller 300 determines that the stitch is the last stitch, the host controller 300 sends the stitch data to the main controller 304, as noted by block 384. After the stitch data has been sent to the main controller 304, the host controller 300 ends thread feed preprocessing operations, as indicated by block 388.

With reference now to FIG. 7, the operations of the main controller 304 when performing thread feed calculations will now be described. In this embodiment, the main controller initially starts thread feed calculations, as noted by block 392. The main controller 304, at block 396, receives stitch data from the host controller 300, which includes the thread feed length. After receiving stitch data, the main controller 304 retrieves data for the first stitch, as noted by block 400. The main controller 304, at block 404, sets the thread feed length to a variable (l). Next, according to block 408, the main controller 304 sets the additional thread variable (a) to add to thread length (l=l+a). The main controller 304, at block 412, adds an overlapping thread length (x) to the thread length (l=l+x). The fabric thickness (f), at block 416, is then added to the thread length by the main controller 304 (l=l+f). The main controller 304 then adds a length for an applique layer thickness (y) (l=l+y), as noted by block 420. It will be understood that the order of these operations may be modified or combined, with such modifications being well within the ability of one skilled in the art.

Next, at block 424, the main controller 304 retrieves thread tension data from the thread sensor controller 308. At block 428, the main controller 304 determines if there is a thread break. If the main controller 304 determines that there is a thread break, it stops the embroidery machine, as noted by block 432. The main controller 304 then waits for the start key to be depressed, as noted by block 436. The main controller 304 next, at block 440, retrieves information for the next stitch. The main controller 304 then repeats the operations associated with blocks 404 through 428. If, at block 428, the main controller 304 determines that there is not a thread break, the main controller 304 determines if the thread tension is too high, as noted by block 444. If the thread tension is too high, the main controller 304 increases the thread feed length, as noted by block 448. If the main controller determines that the thread tension is not too high, it makes a determination, at block 452, whether the thread tension is too low. If the thread tension is too low, the main controller decreases the thread feed length, as noted by block 456. If the main controller 304 at block 452 determines that the thread tension is not too low, and following either block 448 or block 456, where the main controller 304 adjusts the thread feed length, the main controller steps the thread feeder stepper motor, as noted by block 460. The main controller, at block 464, determines if the current stitch is the last stitch. If the stitch is not the last stitch, the main controller 304 proceeds to block 440, to get the next stitch, and repeats the operations described with respect to blocks 404 through 464. If the main controller determines that the current stitch is the last stitch, it ends the thread feed calculations operation, as noted by block 468.

Figure 8:
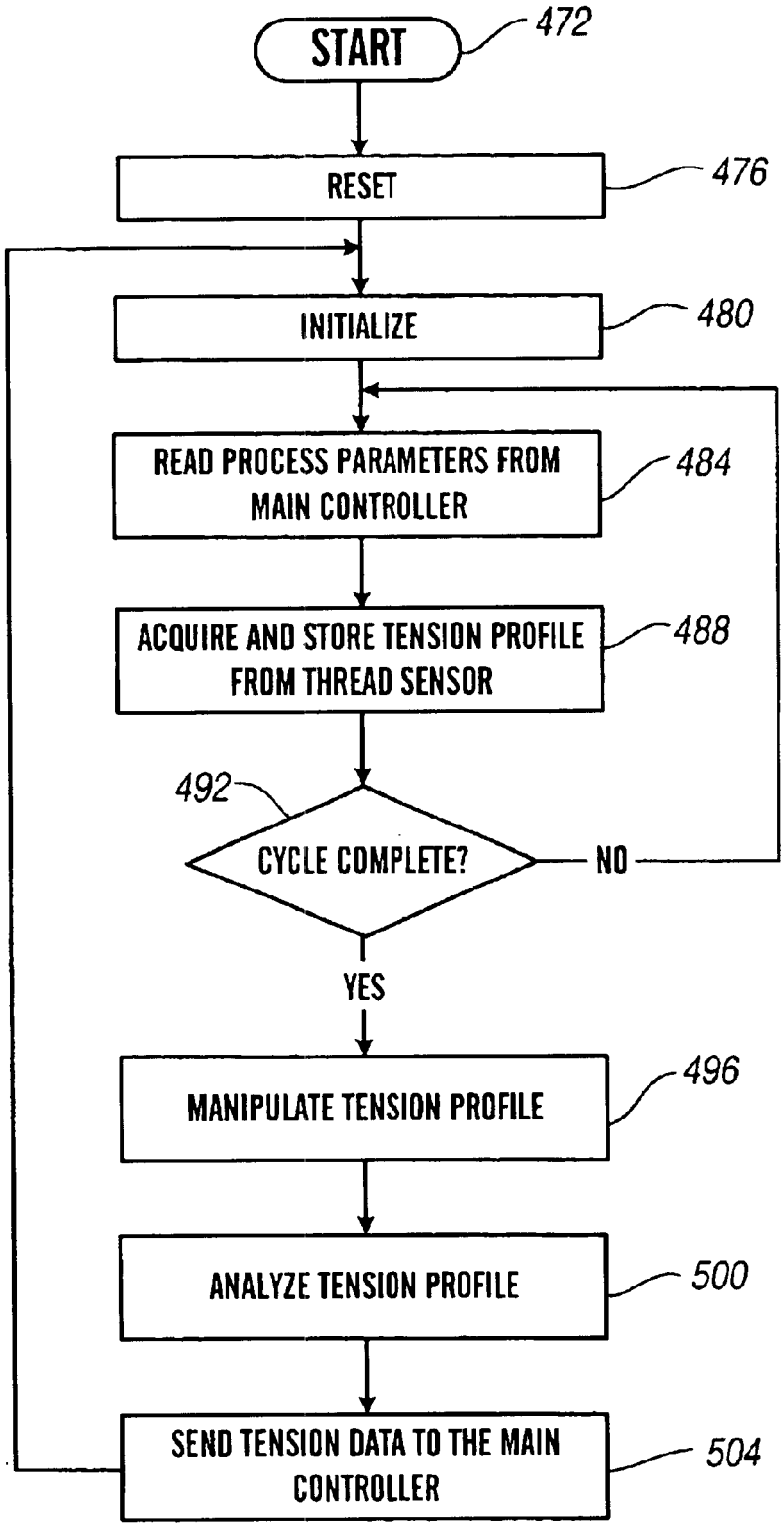
FIG. 8 is a flow chart illustrating the operational steps of a thread sensor controller of one embodiment of the present invention.

With reference now to FIG. 8, the operation of the thread sensor controller 308 will now be described. In the embodiment illustrated in FIG. 8, the thread sensor controller 308 initially starts up, as noted by block 472. The thread sensor controller 308 enters an automatic reset routine, as indicated by block 476, during which electronics associated with the thread sensor are reset. The thread sensor controller 308, at block 480, initializes, during which appropriate registers are cleared and preset variables are stored in the appropriate registers. The thread sensor controller 308 then reads process parameters from the main controller 304, as noted by block 484. These process parameters include timing information and information on the current point in the stitch cycle. Next, according to block 488, the thread sensor controller 308 acquires and stores a thread tension profile from the thread sensor 316. The thread sensor 316 configuration will be described in more detail below. The thread sensor controller then determines if the stitch cycle is complete, as noted by block 492. If the stitch cycle is not complete, the thread sensor controller repeats the operations described above with respect to blocks 484 through 488. If the thread sensor controller 308 determines that the stitch cycle is complete, it then manipulates the tension profile, as indicated by block 496. When manipulating the tension profile, the thread sensor controller aligns the tension profile such that the timing of the tension profile matches the timing of an expected tension profile. The thread tension controller 308 also performs filtering and math operations which results in a modified tension profile which has a reduced noise level.

Next, at block 500, the thread sensor controller 308 analyzes the thread tension profile. When performing the analysis, the thread sensor controller compares a modified thread tension profile to an expected thread tension profile. The thread tension profile is obtained from a thread sensor mounted to the thread guide plate 144, and will be described in more detail below. Based on the differences between the expected and modified thread tension profiles, the thread sensor controller 308 can determine thread tension data. For example, based on an expected thread tension profile, the thread sensor controller can determine if thread tension is relatively high or low for a particular portion of the profile. This determination can then be used to identify if there is a break in the upper or lower thread, or if thread tension is too high or too low. Following the analysis of the thread tension profile, the thread sensor controller sends tension data to the main controller 304, as noted by block 504. The thread sensor controller 308 then repeats the operations associated with blocks 480 through 504.

Figure 9:
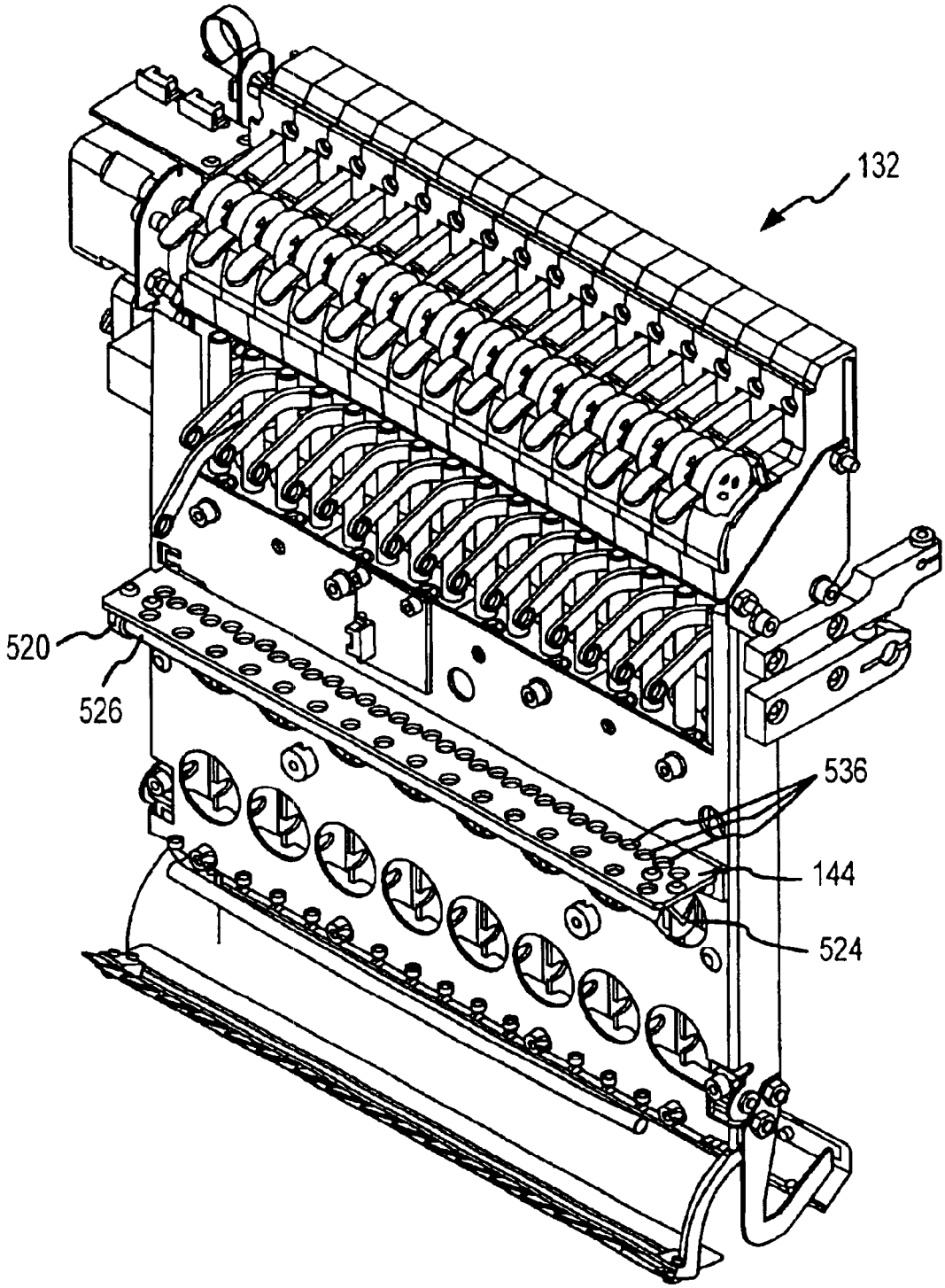
FIG. 9 is a perspective view illustrating a needle case and thread guide plate assembly of one embodiment of the present invention.
Figure 10:
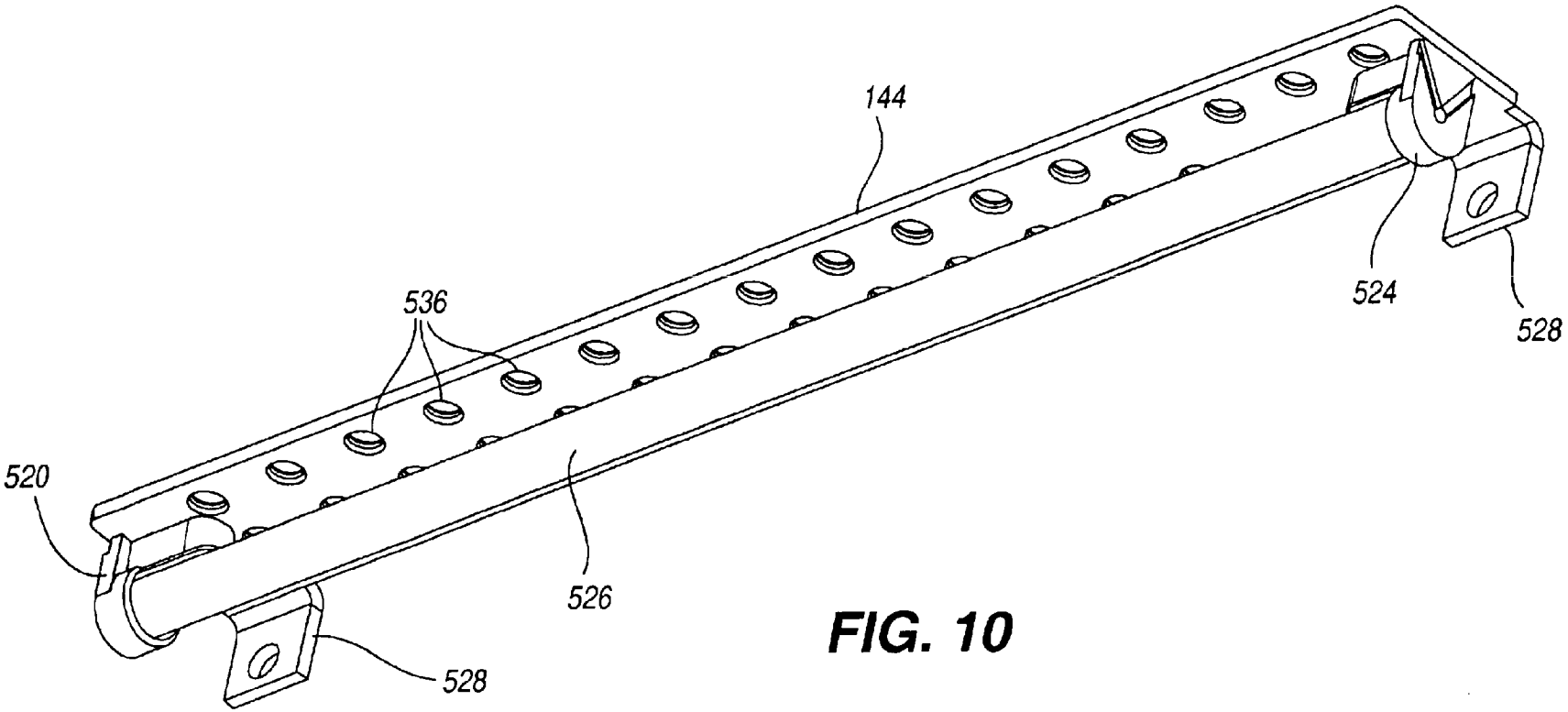
FIG. 10 is a bottom perspective view illustrating a thread guide plate and thread guide tube of one embodiment of the present invention.

With reference now to FIGS. 9 through 12, the thread tension detection hardware and associated circuitry are now described. FIG. 9 is a front perspective illustration of the front of the needle case 132 (with the cover removed) and the thread guide plate 144. FIG. 10 is a lower perspective illustration of the thread guide plate 144, thread guide tube or contact element 526, and a left thread sensor assembly 520 and a right thread sensor assembly 524. The thread guide plate 144 is mounted to the needle case 132 through two mounting tabs 528, located at either end of the thread guide plate 144. The mounting tabs 528 extend downward from the thread guide plate 144, and are connected to the thread guide plate 144 by a strip of metal, or other material. The left thread sensor assembly 520 and the right thread sensor assembly 524 are located near the ends of the thread guide plate 144, and are capable of detecting movement in the thread guide tube 518 relative to the thread guide plate 144. The thread guide plate 144 includes several guide holes 536, for routing the upper thread 208 to the needle assemblies 136.

As in typical embroidery machines, the upper thread 208 originates at a spool (not shown), is routed through the thread feeder assembly 152, to the inner portion of the thread guide plate 144, around the thread guide tube 526, up through the outer portion of the thread guide plate 144, to the take up lever 148, back through the inner portion of the thread guide plate 144, and to the needle 136.

When conducting stitching operations, upper thread 208 moves through the thread guide plate 144 and around the thread guide tube 526, and the tension in the upper thread 208 varies throughout the stitch, placing pressure on the thread guide tube 526. For example, when the needle 136 approaches its lowest point in the stitch circle, the tension on the upper thread 208 is relatively constant. When the upper thread 208 is picked up by the hook in the hook and bobbin assembly, and looped around the lower thread, the needle 136 begins to lift, and the upper thread tension increases. When the needle 136 lifts from the fabric, the upper thread tension increases as the stitch is locked, and reaches a maximum approximately as the needle 136 and take up lever 148 reach their highest point. The upper thread tension then rapidly decreases as the needle 136 and take up lever 148 begin dropping for the next stitch. The tension in the upper thread 208 is translated to the thread guide tube 526. In the embodiment described, the left and right thread sensors 520, 524 are used to monitor this movement in the thread guide tube 526 relative to the thread guide plate 144.

Figure 11:
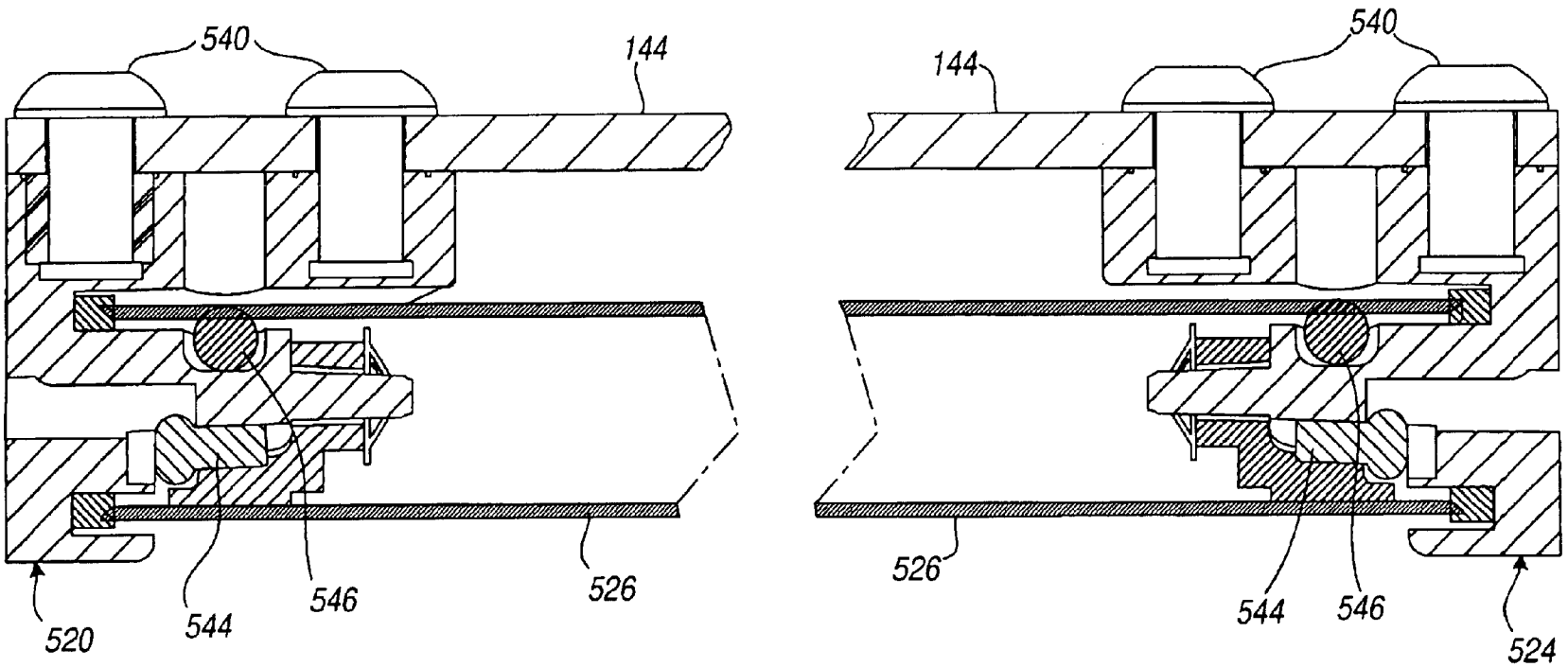
FIG. 11 is a cross sectional illustration of a thread guide plate, thread guide tube, and thread sensor assemblies of one embodiment of the present invention.

In one embodiment, a piezoelectric sensor 544 is located in each thread sensor assembly 520, 524. With reference to FIG. 11, a cross sectional illustration of the thread guide plate 144 and left and right thread sensor assemblies 520, 524 is now discussed. The thread sensor assemblies 520, 524 are mounted to the thread guide plate 144 with two mounting bolts 540. During stitching operations, thread is pulled through the thread guide plate 144, and around the thread guide tube 526. As the thread moves around the thread guide tube 526 during a stitch, the thread guide tube 526 moves with respect to the thread sensor assemblies 520, 524. In the embodiment shown, a resilient material 546, such as a rubber ball, is placed between the upper portion of the thread sensor assembly 520, 524 and the thread guide tube 526, with the piezoelectric sensor 544 located between the lower portion of the thread sensor assembly 520, 524 and the thread guide tube 526. In this manner, the thread guide tube 526 is secured between the thread sensor assemblies 520, 524, and is able to have limited movement with respect to the thread guide plate 144, which can be sensed by the piezoelectric sensors 544. The signal from the piezoelectric sensors 544 is processed and sent to the thread sensor controller 308, as will be discussed in more detail below. Piezoelectric materials, which are well known, convert mechanical stress or strain into proportionate electrical energy. Conversely, these materials also expand and contract when voltages of opposite polarities are applied. In this embodiment, the piezoelectric sensors 544 are used to detect movement in the thread guide tube 526 with respect to the thread guide plate 144. The piezoelectric crystal is capable of detecting movement of the thread guide tube 526 when such movement is in the range of several microns. Thus, even a very small movement in the thread guide tube 526 created by the upper thread tension can be detected by the thread sensors 520, 524. However, the sensitivity of the thread sensors 520, 524 can also result in any movement associated with the embroidery machine 1.00 creating a signal, much of which is noise, which results from a number of sources, including vibration from motors within the machine 100, or vibrations from sources external to the machine 100.

Figure 12:
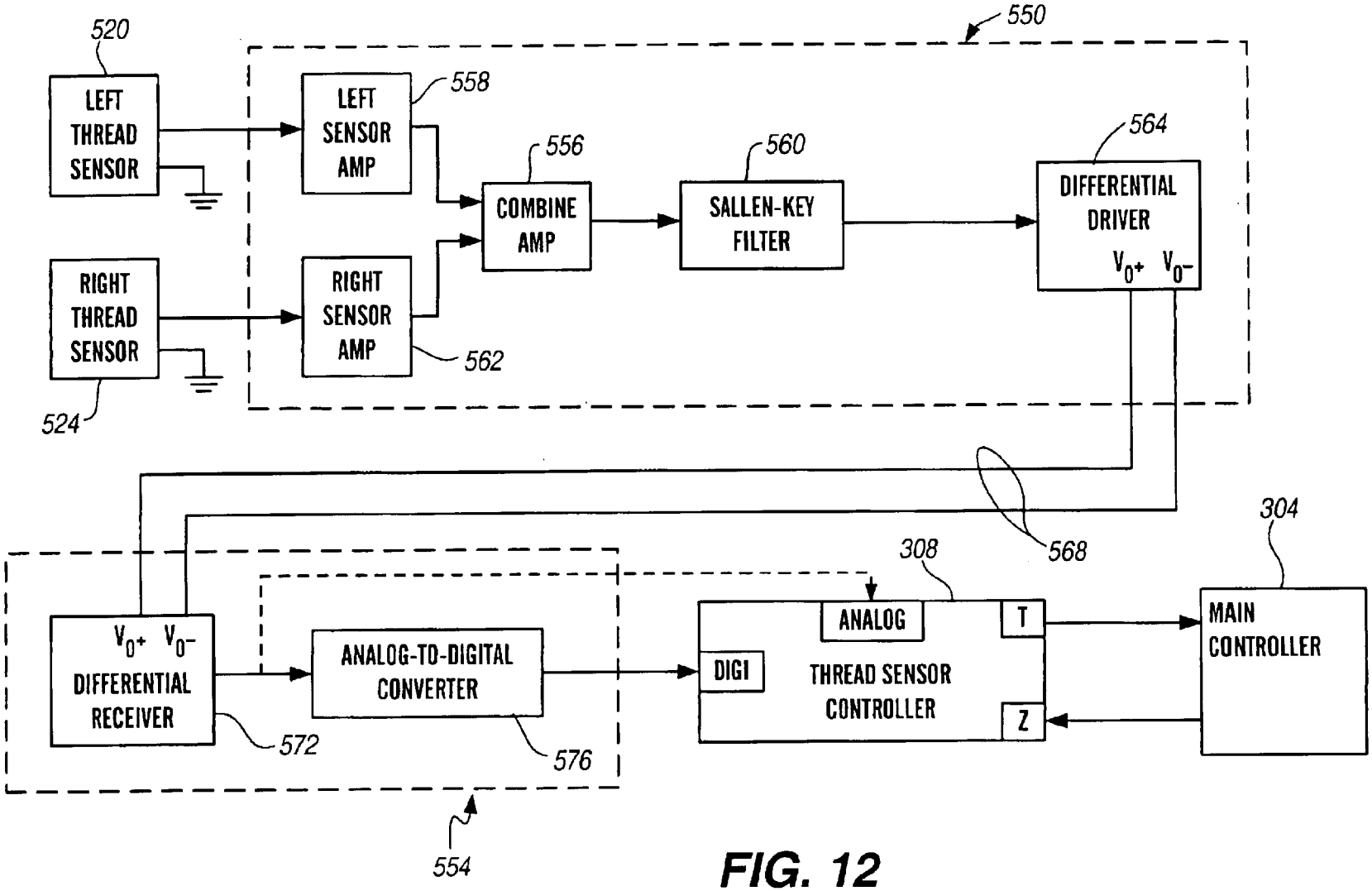
FIG. 12 is a block diagram illustration of the thread sensor controller electronics of one embodiment of the present invention.

Referring now to FIG. 12, a block diagram representation of the thread sensor 316 and thread sensor controller 308 of one embodiment of the present invention is now described. Mounted on the needle case 136, in a location adjacent to the thread guide plate 144, is an instrumentation circuit 550. The instrumentation circuit 550 receives the output of the left and right thread sensors 520, 524, amplifies and filters the signal, and transmits the amplified and filtered signal to a detection circuit 554, which communicates with the thread sensor controller 308, which communicates with the main controller 304 to send thread tension information and receive timing information. Collectively, the left and right thread sensors 520, 524, the instrumentation circuit 550, and the detection circuit 554, make up what is referred to as the thread sensor 316 as described above. The detection circuit 554, thread sensor controller 308, and main controller 304 are located within the base portion 104 of the embroidery machine 100. Within the instrumentation circuit 550 is a left sensor amplifier 558, a right sensor amplifier 562, a voltage combiner and amplifier 556, a Sallen-Key filter 560, and a differential driver 564. The output of the left thread sensor 520 is routed to the left sensor amplifier 558, and the output of the right thread sensor 524 is routed to the right sensor amplifier 562.

The left and right sensor amplifiers 558, 562, in one embodiment, are operational amplifiers, which amplify the received signal, and add a preset voltage offset to the signal. The amplified and offset signals are combined at the combiner/amplifier 556, which outputs a combined signal to a Sallen-Key filter 560, which in one embodiment has a Q of 0.707, and a corner frequency of about 80 kHz. The filtered output is then sent to a differential driver 564 which generates a differential output having a normal signal ($V_{o+}$) and an inverted signal ($V_{o-}$). The differential output is transmitted from the instrumentation circuitry 550 to the detection circuit 554 over a differential line 568, which is an electrical connection using two wires, one of which carries the normal signal ($V_{o+}$) and the other carries the inverted signal ($V_{o-}$). Within the detection circuit 554, is a differential receiver 572 which receives the differential output of the instrumentation circuitry 550. The differential receiver 572 subtracts the inverted signal ($V_{o-}$) from the normal signal ($V_{o+}$) to yield a signal proportional to the input to the differential driver 564. This subtraction is intended to cancel out any noise induced in the differential line 568, on the assumption that the same level of noise will have been induced in both wires of the differential line 568. In one embodiment, twisted pair wiring is used as the differential line 568 to help ensure that the same level of noise is induced in both wires. The output of the differential receiver 572 is routed to an analog to digital converter 576. In one embodiment, the analog to digital converter 576 is a ten (10) bit serial analog to digital converter. The output of the analog to digital converter 576 is then routed to the thread sensor controller 308. In one embodiment, the thread sensor controller 308 is a 16 bit microcontroller having a flash memory. The thread sensor controller 308 receives the output of the analog to digital converter 576, and manipulates and compares the binary string of the analog to digital converter 576 to a reference string which is set by software.

Depending upon the result of the comparison of the binary string to the reference string, the thread sensor controller 308 will send data to the main controller 304 characterizing the current thread tension profile. If the thread sensor controller 308 compares the binary string to the reference string and detects a break in the upper or lower thread, it will send an error to the main controller 304 indicating an upper or lower thread break. When making the comparison of the binary string to the reference string, the thread sensor controller 308 compares the signature of the strings. Alternatively, in one embodiment illustrated by the dashed lines in FIG. 12, the thread sensor controller 308 also has an analog input, and receives the output of the differential receiver 572 directly, with no analog to digital conversion. In this embodiment, the thread sensor controller 308 compares the analog input with a predefined voltage level for different portions of the stitch cycle, and generates a tension signal based on differences detected in the comparison. Timing information is received at the thread sensor controller 308 from the main controller 304, which the thread sensor controller 308 uses to compare the voltage level of the analog signal received from the differential receiver 572 to the predefined voltage.

Figure 13:
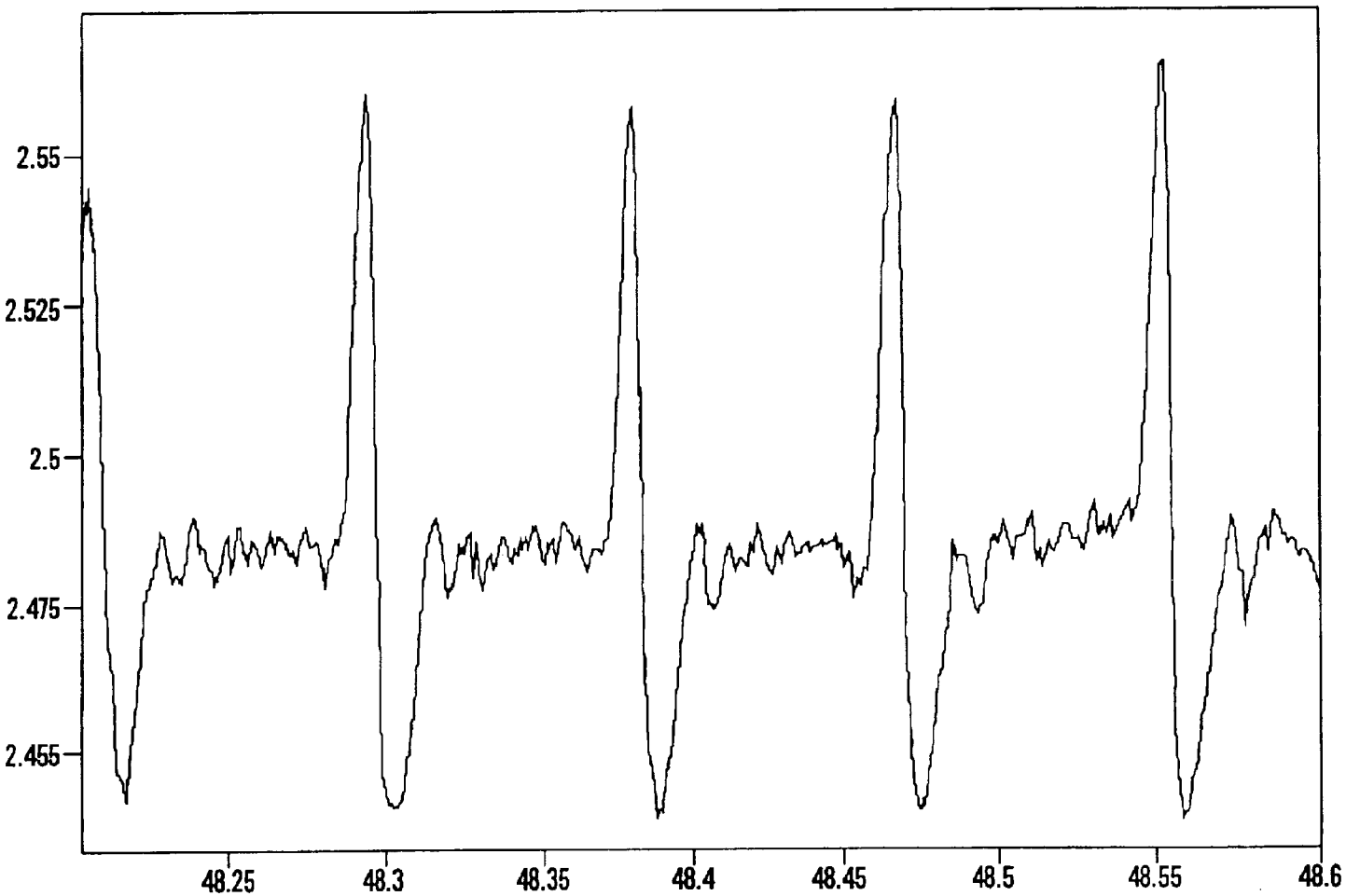
FIG. 13 is a graph illustrating a thread tension profile during normal stitching operations.

Referring now to FIG. 13, the output of the differential receiver 572 is now described. FIG. 13 is a plot illustrating the voltage output of the differential receiver 572 during normal stitching operations with no thread breaks. This plot illustrates the amplified and filtered output of the analog detection sensor 550 and shows several stitch cycles. With reference now to one of the stitch cycles, it can be seen that the cycle has a distinct peak, and a distinct valley. The peak is where the thread is locked in the stitch by the lower thread, and the valley is where the needle has just moved through the top of the stitch cycle. It will be understood that the timing and height of the peaks and valleys will depend upon the embroidery machine parameters, such as, for example, the thread tension when the machine is operating, the number of stitches the machine stitches per minute, and the length of the stitch. The pattern for normal stitching (e.g., a reference or representative predetermined pattern that is indicative of usual or typical pattern stitching) taking such factors into account is used as the reference string in the thread sensor controller 308.

Figure 14:
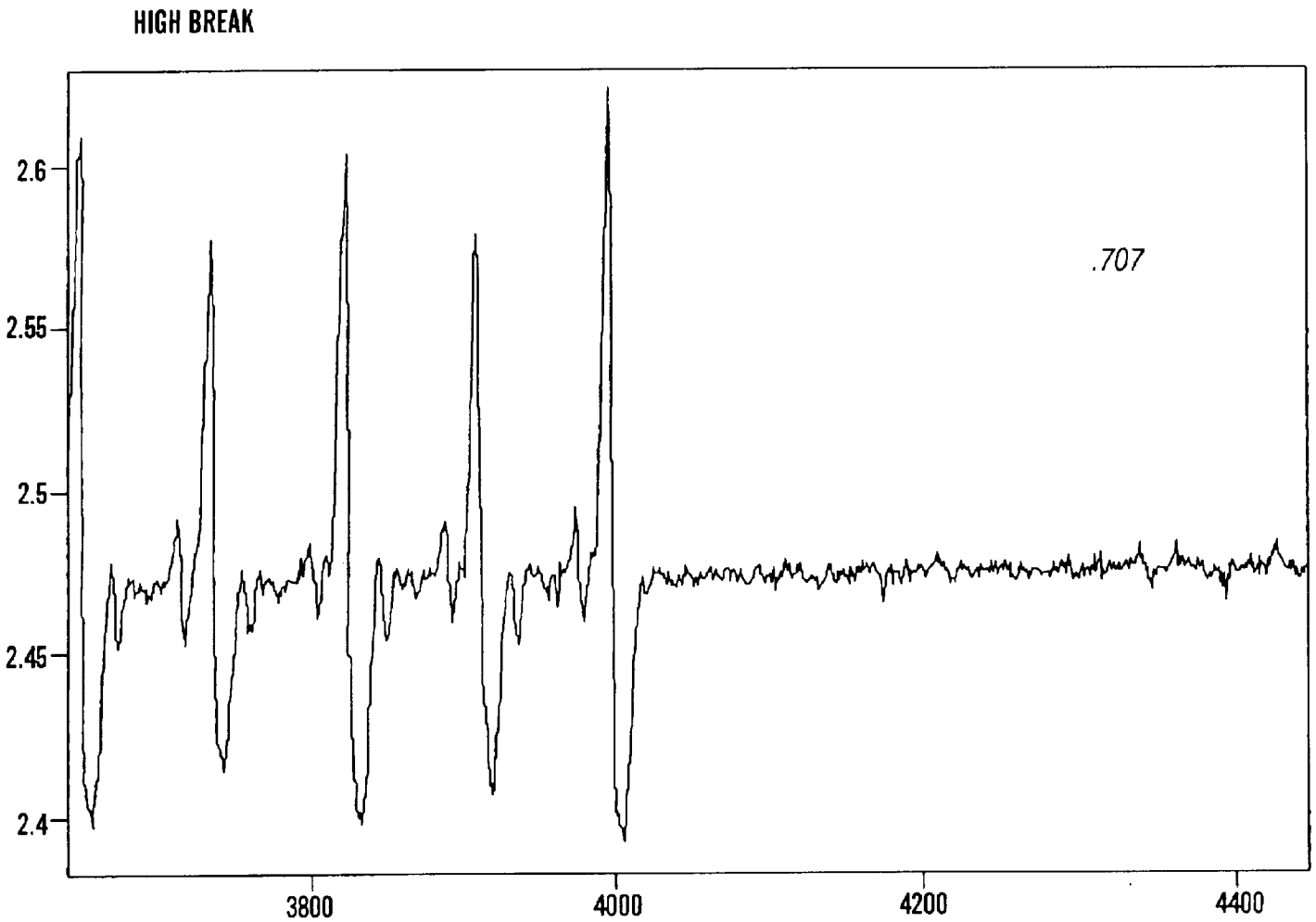
FIG. 14 is a graph illustrating a thread tension profile with an upper thread break.

FIG. 14 illustrates the output of the differential receiver 572 when the upper thread breaks. As can be seen from the plot, the peaks and valleys are no longer present when the upper thread breaks. The thread sensor controller 308 compares this to the reference string, and generates a signal based on the difference between the reference string and the output of the differential receiver 572 which is sent to the main controller 304. In the event of a thread break, which results in a signal which has relatively small changes in thread tension, the thread sensor controller 308 sends an error signal to the main controller 304, indicating that there is an upper thread break.

Figure 15:
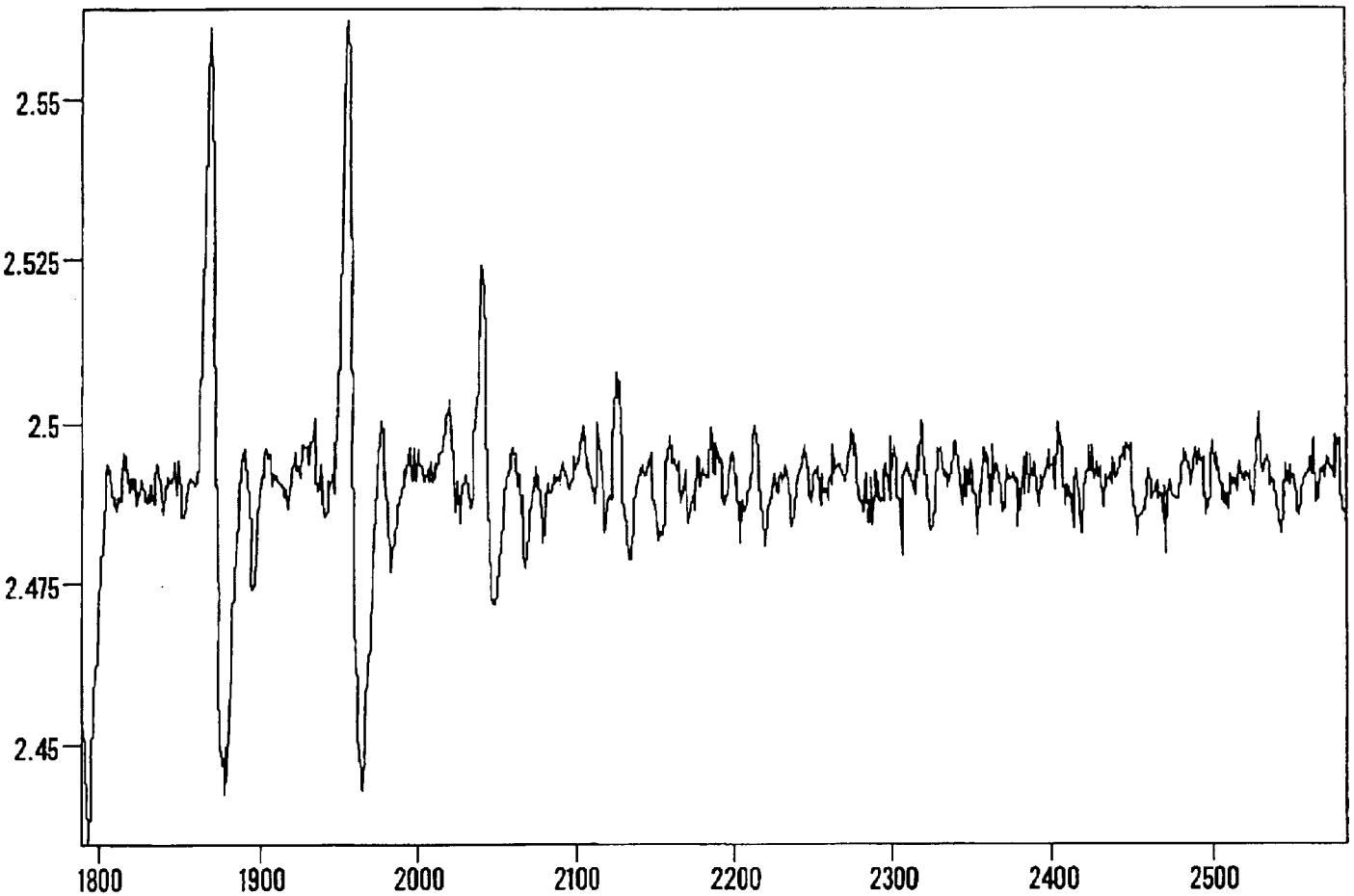
FIG. 15 is a graph illustrating a thread tension profile with a lower thread break.

FIG. 15 illustrates the output of the differential receiver in the event of a break in the lower thread. As can be seen from the plot, when the lower thread breaks, the magnitude of the peaks and valleys is reduced for the first one to three stitches, following which the peaks and valleys essentially disappear. This is a result of the stitches no longer being locked by the lower thread. The tension in the upper thread in such a case is reduced for a period, as a result of tension from the last stitch which was locked prior to the lower thread breaking. As more upper thread gets fed to the needle assembly, this tension is reduced as more stitches are attempted. The thread sensor controller 308 can compare the reduced height of the peaks to the reference string, and, if the peak disappears, it can generate an error signal indicating a break in the lower thread, and send the error to the main controller 304. Thus, based on the analysis of the thread tension profile, the thread sensor controller 308 is able to determine tension data, and upper or lower thread breaks.

Figure 16:
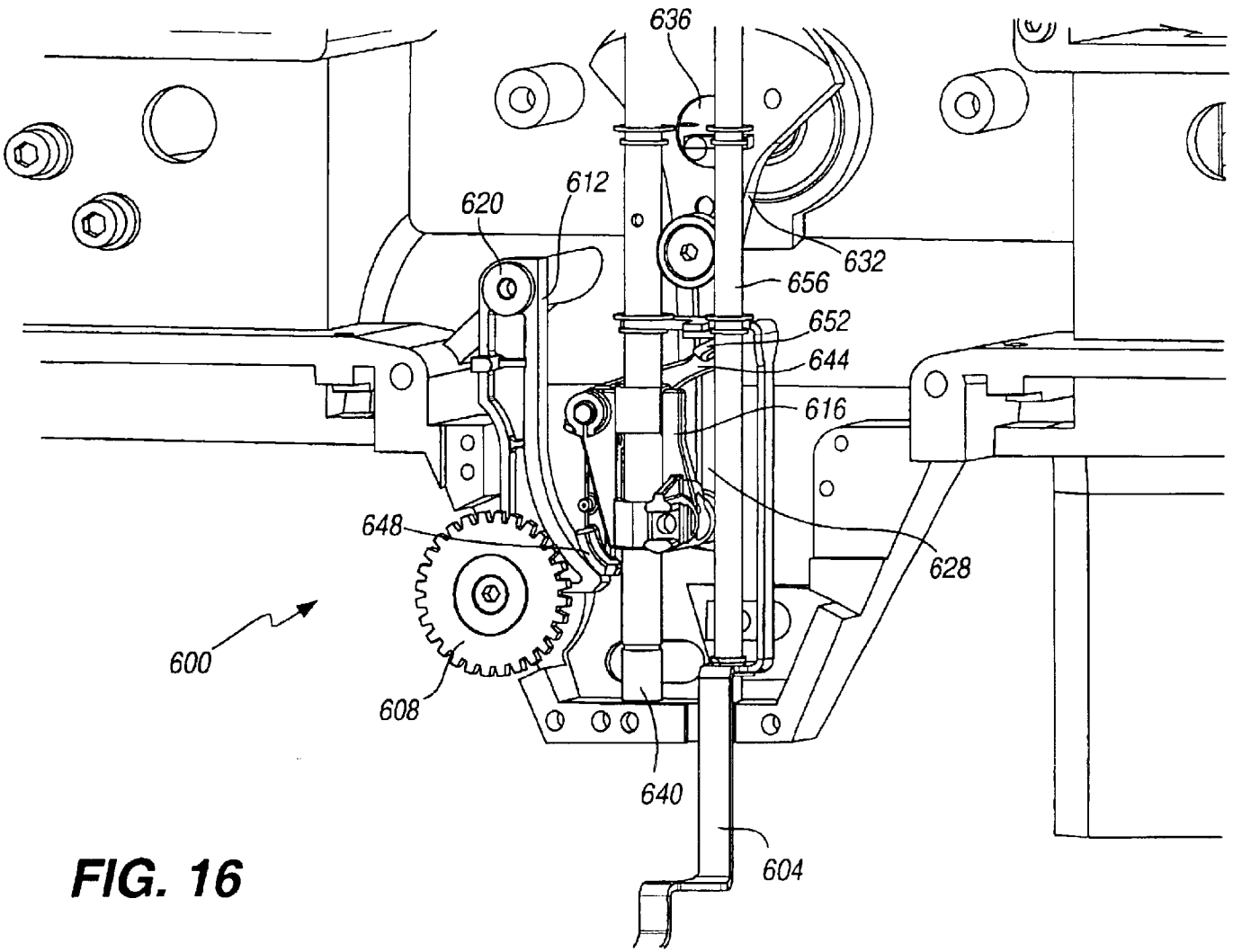
FIG. 16 is a front perspective view illustrating an adjustable presser foot assembly of one embodiment of the present invention.
Figure 17:
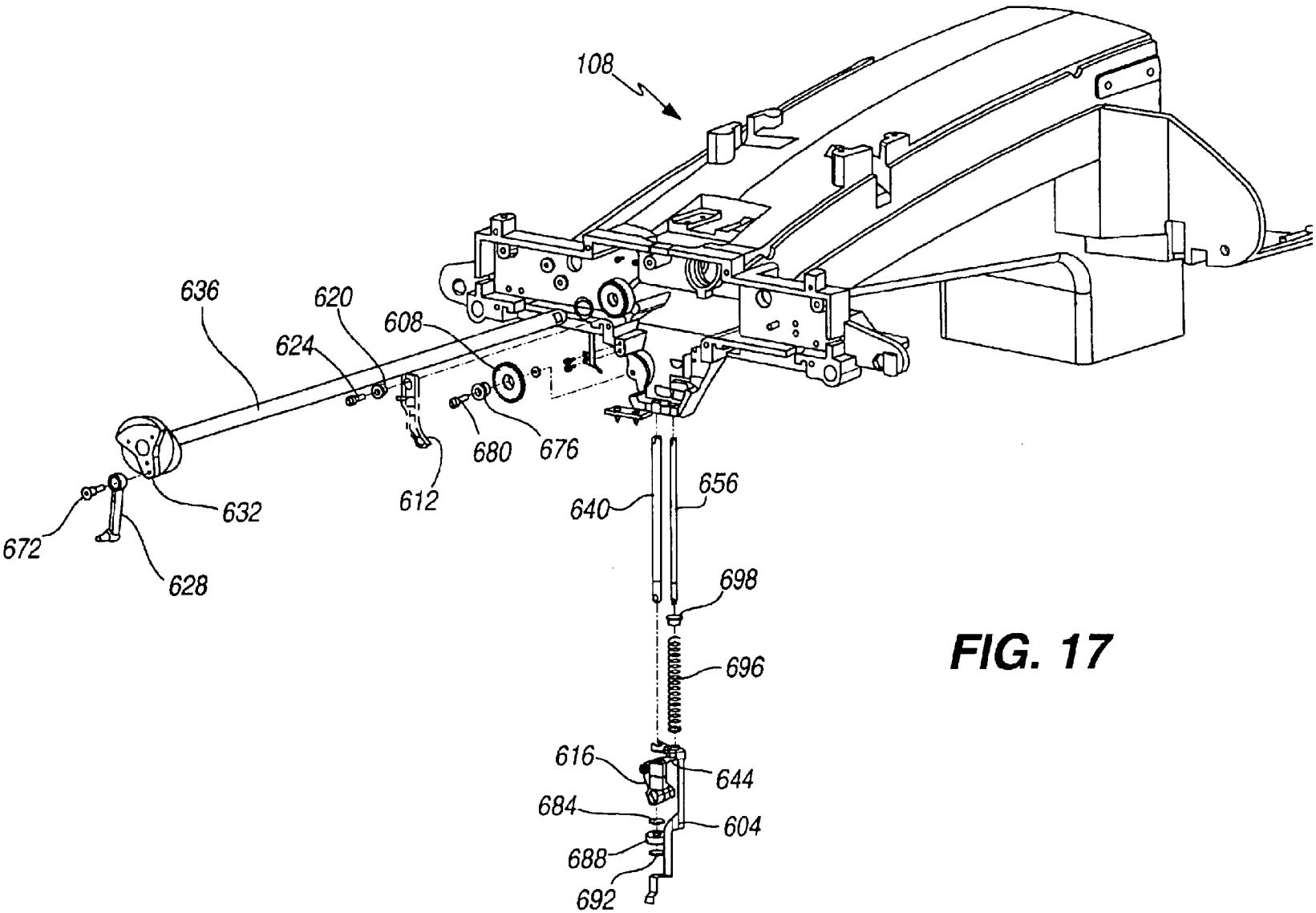
FIG. 17 is an exploded perspective illustration of an adjustable presser foot assembly of one embodiment of the present invention.

Referring now to FIGS. 16 through 19, the construction and operation of the presser foot assembly 600 is now described. FIG. 16 illustrates a perspective view of the presser foot assembly 600, and FIG. 17 illustrates an exploded view of the presser foot assembly 600 in relation to the upper arm assembly 108. In one embodiment, the height of the presser foot 604 is adjusted by moving a height adjustment eccentric 608. The height adjustment eccentric 608 operates to move the bottom portion of a cam 612 towards or away from a reciprocator assembly 616. The cam 612 is pivotally mounted to the upper arm 108 by a bushing 620 and a bolt 624. The reciprocator assembly 616 is connected to a connecting rod 628 which connects to a crank arm 632, which is attached to an upper shaft 636. When the upper shaft 636 rotates the crank arm 632, the connecting rod 628 acts to move the reciprocator assembly 616 up and down about a reciprocator shaft guide 640. Attached to the reciprocator assembly 616 is a cam follower 644, which engages with the cam 612 at a first end 648, and engages the presser foot 604 at a second end 652. As the reciprocator assembly 616 reciprocates along the reciprocator shaft guide 640, the first end 648 of the cam follower 644 moves along the cam 612, which in turn moves the second end 652 of the cam follower 644, which in turn moves the presser foot 604 up and down along a presser foot shaft guide 656. Thus, as the cam 612 is adjusted inward or outward, the height of the presser foot 604 is changed. The height adjustment eccentric 608 can be adjusted as the embroidery machine is operating, thus enabling the height of the presser foot 604 to be adjusted and fine tuned to proper height while the embroidery machine is conducting stitching operations.

Figure 19:
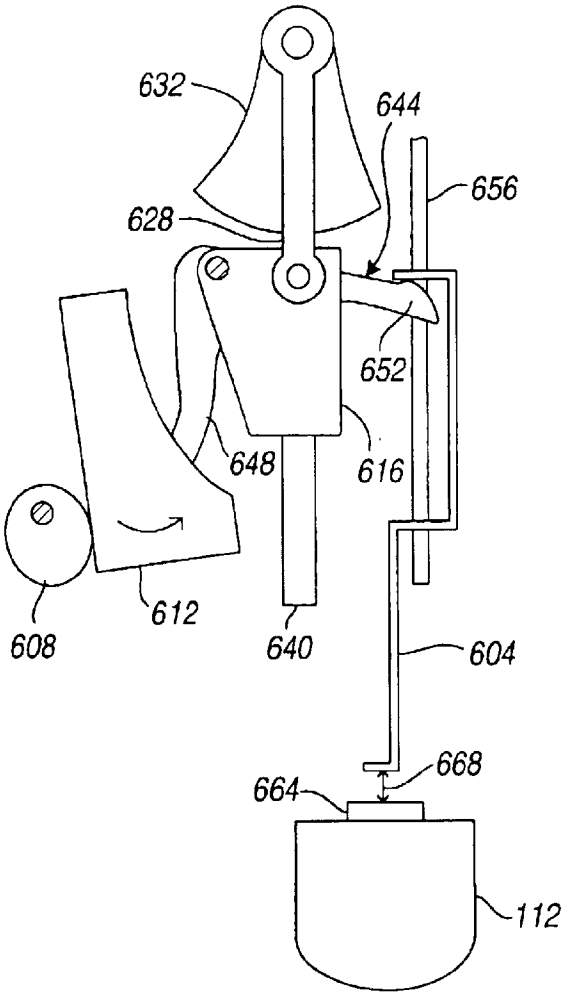
FIGS. 18 and 19 are illustrations of the adjustment of an adjustable presser foot assembly of one embodiment of the present invention.
Figure 18:
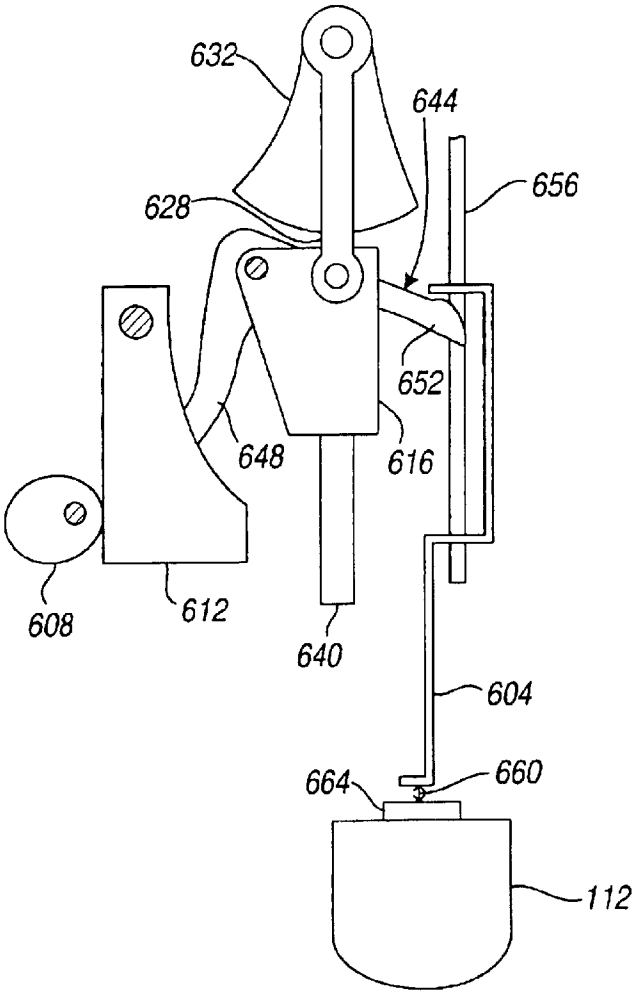

Referring now to FIGS. 18 and 19, a simplified illustration of the presser foot assembly 600 and its adjustment is now described. The illustrations of FIGS. 18 and 19 should be understood to be for the purpose of illustrating the concept of the above described height adjustment mechanism, which has a scale which is exaggerated for the purposes of a clear illustration. As can be seen in FIG. 18, when the upper shaft 636 and crank arm 632 are positioned such that the reciprocator assembly 616 is in its highest position, the cam follower 644 is in a position along the cam 612 where the second end 652 of the cam follower 644 is at its lowest position, and the presser foot 604 is thus in its lowest position. With the presser foot 604 in its lowest position, there is a first distance 660 between the presser foot 604 and the needle plate 664 located in the lower arm assembly 112. Referring now to: FIG. 19, the height adjustment eccentric 608 is adjusted so as to move the cam 612 in an inward direction, closer to the reciprocator assembly 616. As a result, when the reciprocator assembly 616 is in its highest position, and the second end 652 of the cam follower 644 is in its lowest position, the presser foot 604 has a lowest position which results in a second distance 668 between the presser foot 604 and the needle plate 664.

Referring again to FIG. 17, the exploded view of one embodiment of the presser foot assembly 600 is further described. In this embodiment, the upper shaft 636 is inserted into the upper arm assembly 108 and is driven by a motor (not shown) located at the rear of the upper arm assembly 108. Attached to the end of the upper shaft 636 is a crank arm 632, which connects to the connecting rod 628. A bolt 672 connects the connecting rod 628 to the crank arm 632 such that rotation is allowed. The cam 612 is mounted to the upper arm assembly 108 using a bolt 624 and a bushing 620, such that the cam 612 can pivot around the bushing 620. The height adjustment eccentric 608 is mounted on the upper arm assembly 108 using a boss 676 and a bolt 680, such that the height adjustment eccentric 608 can rotate about the boss 676. As mentioned above, the reciprocator assembly 616 reciprocates on a reciprocator shaft guide 640, and the presser foot 604 moves along the presser foot shaft guide 656. Both the reciprocator shaft guide 640 and the presser foot shaft guide 656 are mounted to the upper arm assembly 108. The reciprocator assembly 616 is coupled to the reciprocator shaft guide 640 by a spacer 684, a ball bearing 688, and a clip 692. The presser foot 604 is coupled to the presser foot shaft guide 656, and a spring 696 is arranged around the presser foot shaft guide 656 such that a downward force is placed on the presser foot 604. A plastic bearing 698 is located at the top portion of the spring 696 to provide reduced friction between the top portion of the spring 696 and the portion of the upper arm assembly 108 which it contacts. Thus, a downward force is placed on the presser foot 604 such that when the reciprocator assembly 616 moves upward along the reciprocator shaft guide 640, causing the second end 652 of the cam follower 644 to drop, a force from the spring 696 is placed on the presser foot 604. Likewise, when the reciprocator assembly 616 moves downward along the reciprocator shaft guide 640, causing the second end 652 of the cam follower 644 to rise, the presser foot 604 will rise, compressing the spring 696.

Figure 20:
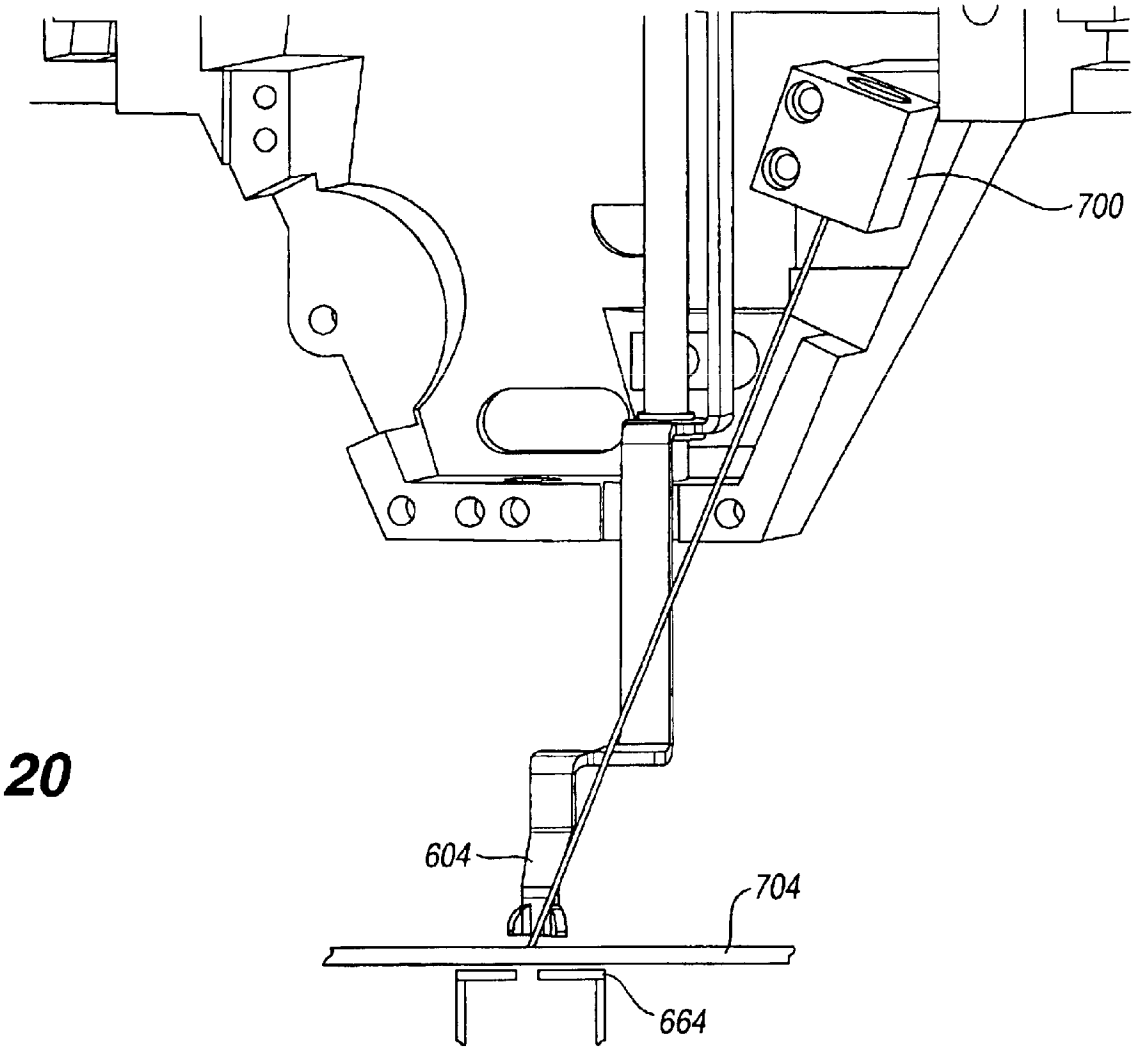
FIG. 20 is a front perspective illustration of a laser assembly and associated hardware of one embodiment of the present invention.

As previously described, many times the stitching position of a needle needs to be verified. As discussed, this is necessary, for example, to verify that the needle will not strike the hoop at any time during stitching of a pattern, to verify the starting location of a stitch, or to verify the proper location of an applique. Referring now to FIG. 20, in one embodiment, the present invention provides a laser assembly 700 which is mounted to the upper arm assembly 108. The laser assembly 700 is mounted such that the position of the laser light on the fabric 704 will correspond to the point at which the needle 136 will penetrate the fabric 704. Also, the laser assembly 700 is mounted in such a way that any laser light from the laser assembly 700 is not obstructed from the fabric 704, and is also preferably mounted such that hardware associated with the hoop assembly which holds the fabric 704 or garment does not block the laser light from hitting the fabric 704 at any point in the design. The embroidery machine 100 contains a pattern and hoop verification routine, in which the pattern and hoop size are input into the main processor portion of the machine. The main processor then perform's a comparison to verify that when stitching the pattern, the needle will not strike the hoop.

In some instances, incorrect data may be entered into the embroidery machine 100, or an incorrect hoop may be placed on the embroidery machine 100. In these cases, even though the hoop verification routine is successful, the needle may still strike the hoop. In order to reduce these type of occurrences, in addition to the hoop verification routine, the laser within the laser assembly 700 may be activated, and the hoop is moved in a manner to trace the outline of the pattern to be stitched. An operator can then verify that the laser light does not contact the hoop at any point during the tracing routine. Once the operator has verified that the laser, and thus the needle 136, will not contact the hoop at any point of the pattern to be stitched, stitching operations can be started.

Additionally, the user interface 120 contains a switch 708, which can be used to manually activate the laser. The user interface 120 also contains a manual maneuvering lever 712, which can be used to adjust the X-Y position of the garment on the machine. With the laser activated, the starting position of a stitch can be located, and the garment adjusted beneath the laser light to properly set the starting position of the machine. This same technique can be used to properly position an applique on a garment, and to adjust the position of the garment for stitching of the applique. Thus, the pattern and starting location of the machine can be verified without the need to manually pull a needle down to a position close to the fabric to be stitched.

Figure 21:
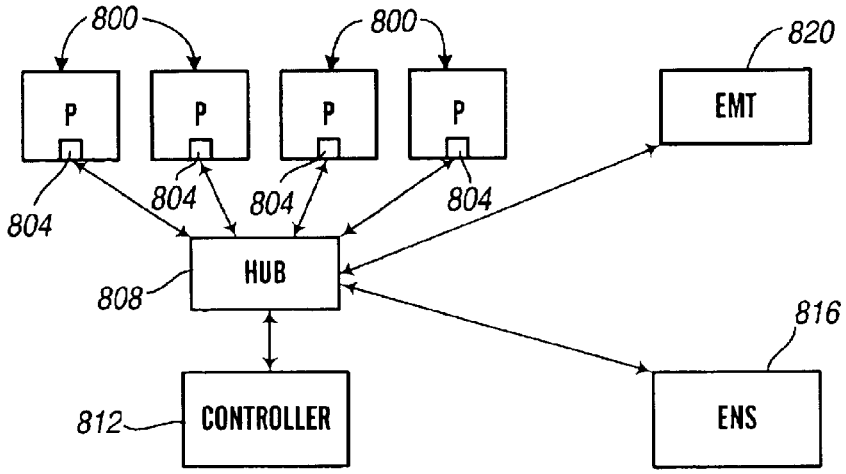
FIG. 21 is a block diagram illustration of a system of embroidery machines of one embodiment of the present invention.

As described above, often it is advantageous to have multiple garments stitched simultaneously. In one embodiment, the present invention is capable of electronically coupling two or more separable, independently functional stitching machines, e.g., embroidery machines, in order to create a multi-head stitching machine. In this embodiment, as illustrated in FIG. 21, each embroidery machine 800 has a network connection 804, which connects the embroidery machine 800 to an ethernet hub 808. The ethernet hub 808 is connected to a controller 812, which communicates with each embroidery machine 800 through the ethernet hub 808. Also, optionally connected to the ethernet hub 808 is an embroidery network system (ENS) 816, and may, optionally, be connected to other embroidery machines 800. The controller 812 is used to download stitching designs to the individual embroidery machines 800, and also to verify that the embroidery machines 800 are properly operating and have correct software revisions.

Figure 22:
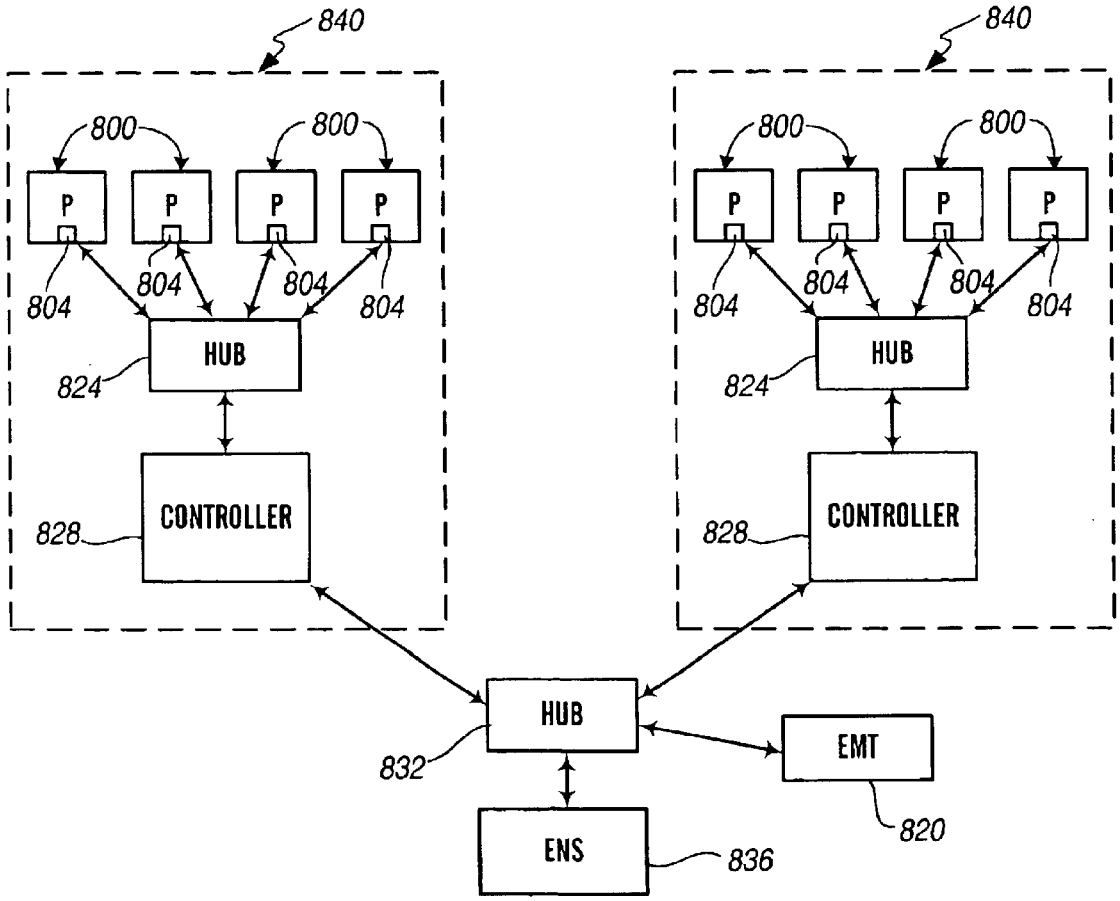
FIG. 22 is a block diagram illustration of a system of embroidery machines having two clusters of one embodiment of the present invention.

In another embodiment, illustrated in FIG. 22, several clusters of embroidery machines 800 may be networked together. In this embodiment, several embroidery machines 800 are connected to an ethernet hub 824, which is connected to a controller 828. The controller 828 is in turn connected to a central hub 832. The central hub 832 is connected to an ENS controller 836, and, optionally, to other embroidery machines 820 referred to in one embodiment as embroidery machines tubular (EMT).

In one embodiment, a plurality of embroidery machines 800 is a member of a logical cluster 840. In one embodiment, each cluster 840 may have no more than thirty (30) machines, and there may be no more than six (6) clusters 840 on any one LAN segment. Embroidery machines 800 within a cluster 840 communicate with each other for the purpose of control and synchronization. When such control and synchronization messages are communicated, an embroidery machine 800 will communicate the message as a broadcast message on the LAN. Each communication has a cluster number in the header for the communication. This way, an embroidery machine 800 in another logical cluster 840 which receives the command can ignore the command, and machines within the cluster 840 can act upon the command. The controller 828 receives all broadcasted commands, and may act on them as required.

When a new design is required to be stitched into a plurality of garments or fabric, a user will access the controller 828 through a user interface. The user interface may be any suitable interface with which a user may input and/or select a design to be stitched using the embroidery machines connected to the controller 828. In one embodiment, the user interface is a PC host, which operates using a graphic user interface. The controller 828 receives the design to be stitched, and communicates the design to the embroidery machines connected to the controller 828.

In one embodiment, each device on the network includes an Ethernet connection, which is used for communication on the network. In one embodiment, the communication protocol used for the network is Internetwork Packet Exchange (IPX), developed by Novell, Inc, and which is well known in the art.

Each embroidery machine in a system is configured with a cluster number, a head number, and a master/slave flag. When used in a network such as this, each individual embroidery machine is considered to be a stitching head, and has an associated head number. There may be multiple clusters per network, and multiple heads per cluster. Each cluster has one master embroidery machine. When in operation, synchronization of multiple heads is maintained by protocol mechanisms, as will be described in further detail below. The embroidery machines in a cluster are not mechanically coupled to each other. Mechanical synchronization is achieved by having the master embroidery machine broadcast a stitch synchronization packet at regular intervals. This packet contains information related to the stitch count, which the slave embroidery machines use to verify synchronization with the master embroidery machine. If the master embroidery machine discontinues the broadcast of the stitch synchronization packet, all of the embroidery machines within the cluster will halt. In one embodiment, each slave embroidery machine is programmed to expect a stitch synchronization packet at regular predetermined intervals. If such a packet does not arrive within the predetermined interval, the machine will halt. It will be understood that several alternatives exist for insuring the master embroidery machine is still operating, such as, for example, a heartbeat signal sent from the master to the slaves.

In addition to the stitch synchronization packet broadcast by the master embroidery machine, each slave embroidery machine transmits a heartbeat packet to the master embroidery machine at regular predetermined intervals. If the master embroidery machine fails to receive a heartbeat packet from any of the slave embroidery machines within the predetermined interval, it will broadcast a stop command to all of the embroidery machines on the cluster.

At the start of a job, a job synchronization is broadcast from the master embroidery machine to the slave embroidery machine(s). This packet includes information regarding the stitching operations during the job, such as initial embroidery machine speed and color change sequence. This job synchronization is used to synchronize the initial operating parameters of each embroidery machine in the cluster. Once the machines begin stitching operations, synchronization is maintained using the above described synchronization packets sent by the master embroidery machine.

The master embroidery machine for a cluster is determined automatically by software running on each embroidery machine. As each embroidery machine comes online, a Find Master packet is broadcast over the network. If a valid response is received, the machine which broadcast the message will automatically configure itself to be a slave. A valid response, in one embodiment, is a response to the Find Master packet which matches the cluster number of the broadcasting machine. If a valid response is not received within a predetermined period of time, the embroidery machine which broadcast the message will configure itself to be a master embroidery machine. In one embodiment, if a master embroidery machine receives a packet from another embroidery machine which indicates that the other embroidery machine is a master, the receiving embroidery machine will reconfigure itself to be a slave embroidery machine. When an uninitialized embroidery machine comes online and attempts to find a master embroidery machine, it will be configured as a slave if a master embroidery machine is found. A more detailed operation of one embodiment for determining master and slave status of a head will be described below.

When a master embroidery machine receives a Find Master packet, the master embroidery machine verifies that the request is from the same cluster number, and if so, responds with a master acknowledgment packet, which includes a response to the Find and adds the slave embroidery machine to an internal list of slaves. The above description also works for single head use.

As can be seen, this allows additional embroidery machines to be added to an embroidery system with relative ease. Furthermore, embroidery machines may also be removed with relative ease. Thus, for example, if one embroidery machine in the system needs to be taken down for maintenance, it can simply be disconnected from the network, and the remainder of the embroidery machines may continue to be operated. When maintenance is finished on the embroidery machine which was disconnected from the network, it can be reconnected and included in the system again.

Figure 23:
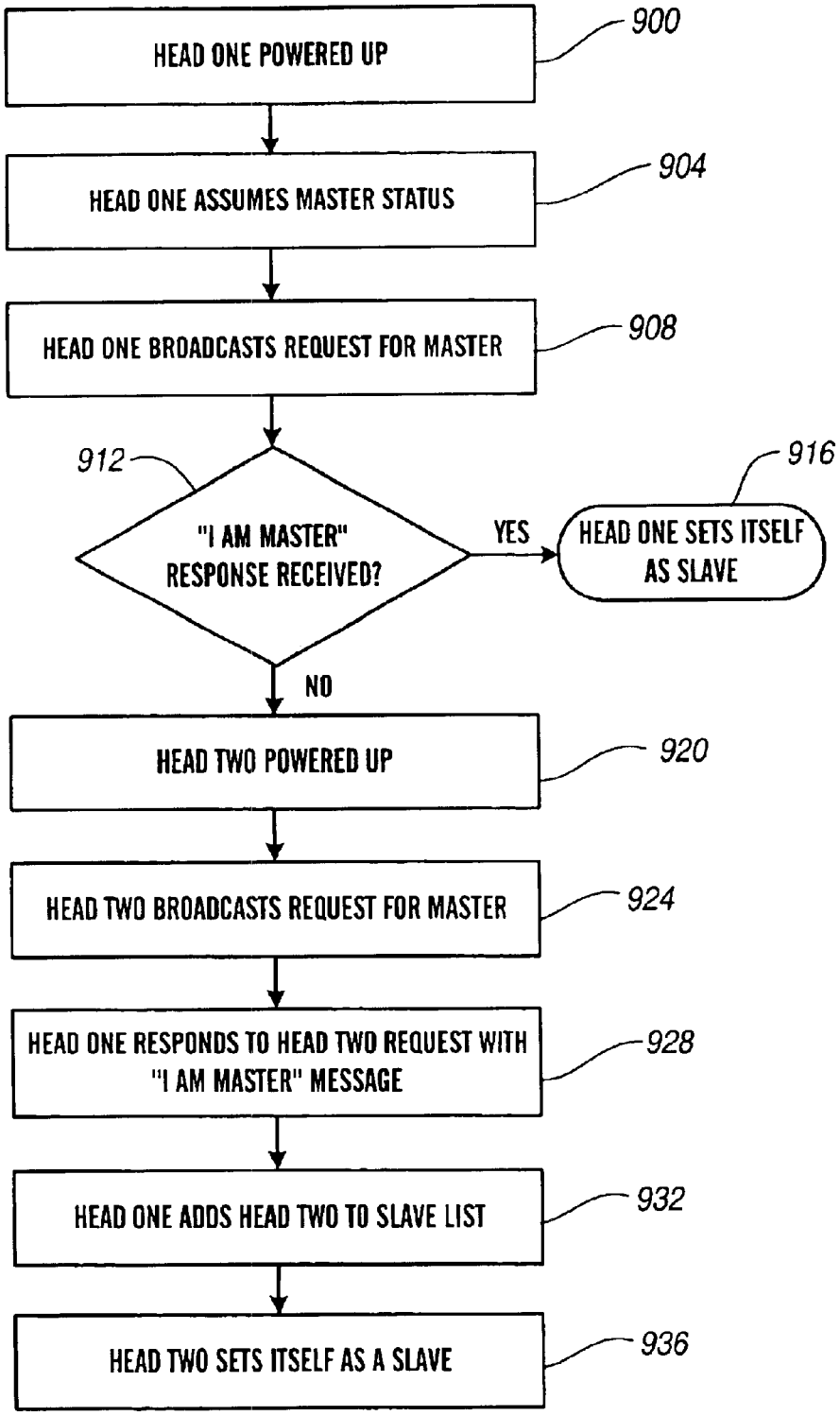
FIG. 23 is a flow chart illustration of the operational steps for powering up a networked embroidery machine of one embodiment of the present invention.
Figure 25:
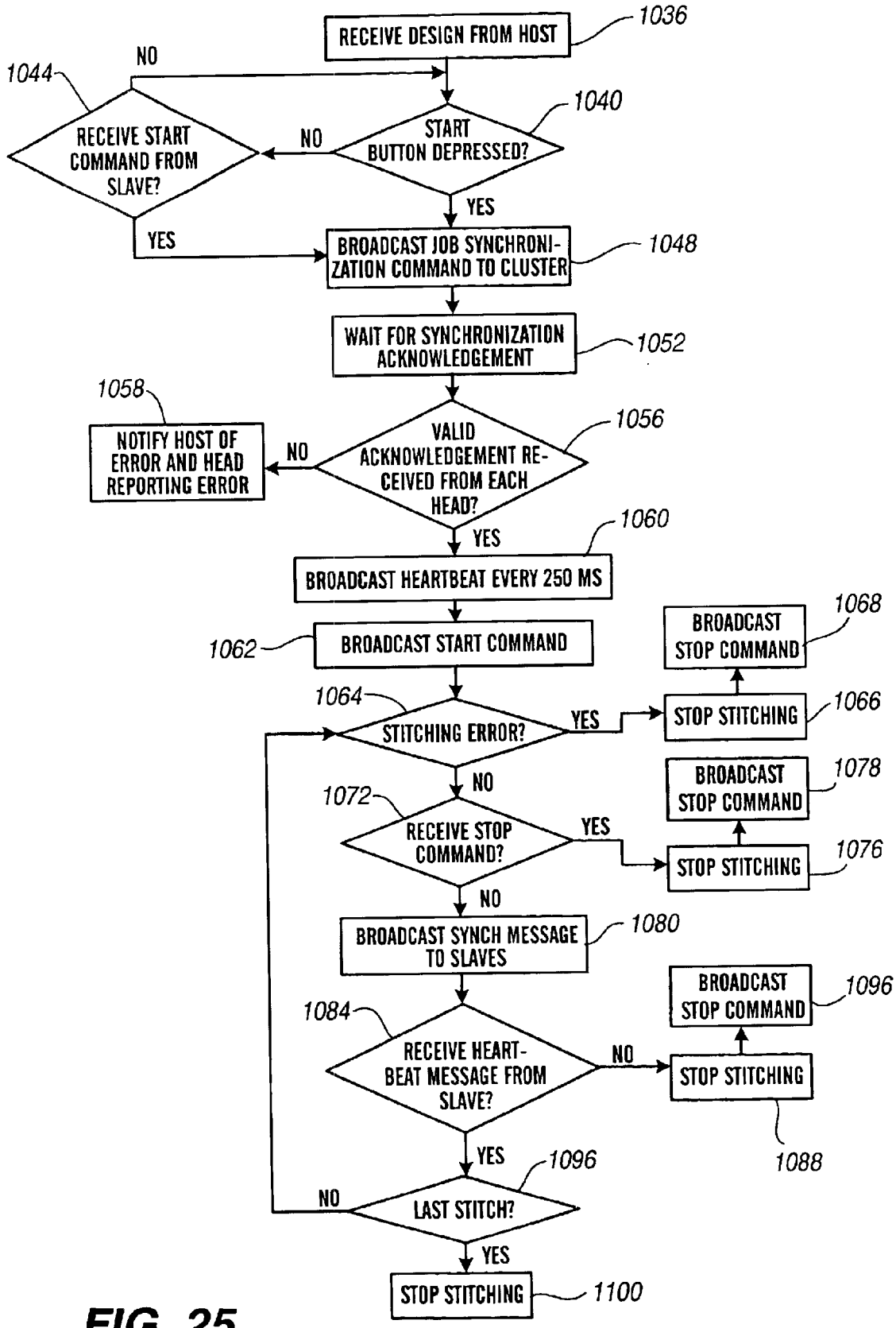
FIG. 25 is a flow chart illustration of the operational steps for stitching a design using a master head of one embodiment of the present invention.

Referring now to FIGS. 23–25, the operation of the master and slave embroidery machines for one embodiment is now described. First, with reference to FIG. 23, the operation of heads during power up is described. Initially, indicated by block 900, head one is powered up. Upon being powered up, head one assumes master status, as indicated by block 904. Head one broadcasts a request for master message to all devices in the cluster, as noted by block 908. In this embodiment, a cluster number is assigned to the head by the controller, which is read by the head when it is powered up. This cluster number is used in the request for master message. Next, at block 912, head one determines if an "I Am Master" response message is received. If such a response is received, head one sets itself as a slave, as noted by block 916. In one embodiment, a head will wait a predetermined time to receive a response to the request for master message, after the expiration of which it will assume no other head is set as a master. Next, according to block 920, head two is powered up. Upon being powered up, head two broadcasts a request for master message to all devices in the cluster, as noted by block 924. Head one, upon receiving the request for master message, responds to the message with an "I Am Master" response, as indicated by block 928. Head one then adds head two to its internal list of slave heads, as noted by block 932. Head two, as noted by block 936, sets itself as a slave. In one embodiment, the controller communicates the number of heads in a cluster to the heads at power up. The master head stores this number, and prior to beginning stitching operations, verifies that the number of slave heads in the list of slave heads matches the number received from the controller. If the numbers do not match, the master head will return an error message to the controller.

Referring now to the flow chart illustration of FIG. 24, the operation of a slave head during stitching operations is described. In this embodiment, the slave receives a design from the host (controller) computer, as noted by block 940. Once the design is downloaded, the slave head waits for a start button to be depressed, as noted by block 944. The start button may be depressed on any head in the cluster. If the start button is depressed on a slave head, the slave head communicates the start command to the master head. The start command is received at the master head, as indicated by block 948. Alternatively, the slave head may broadcast a start command to all heads. Following block 948 the slave head receives a synchronization command from the master head, as noted by block 952. In one embodiment, the synchronization command includes information regarding the initial stitching speed, starting position for the design to be stitched, and stitch count. Once a synchronization command is received, the slave head verifies all of the information in the job synchronization command, and returns a synchronization status to the master head, as noted by block 956. Once the master head has received synchronization status from all of the slave heads which indicate that they are synchronized, it sends a start command which is received by the slave heads, as noted by block 960. At block 962, the slave head transmits a heartbeat message to the master head. The heartbeat runs at all times in order that the master head may monitor the system for any malfunctioning heads. In one embodiment, the slave head transmits a heartbeat message at predetermined intervals of 250 milliseconds. The slave head then begins stitching, as noted by block 964.

During stitching, the slave head monitors for a stitching error, as noted by block 968. In the event of a stitching error, the slave head stops stitching, according to block 972, and broadcasts a stop command to all of the devices in the cluster, as noted by block 976. The slave head, at block 980, monitors for a stop command received from another device in the cluster. If such a stop command is received, the slave head stops stitching, according to block 984, and broadcasts a stop command to all of the devices in the cluster, as noted by block 986. The slave head, at block 988, verifies that it has received a heartbeat message from the master head. In one embodiment, the slave head expects to receive such a message at predetermined intervals of 250 milliseconds. If a master head heartbeat is not received, the slave head stops stitching, as noted by block 992, and broadcasts a stop command to all of the devices in the cluster, as noted by block 996. If the slave head does receive a heartbeat message from the master head, it verifies, at block 1000, that it has received a synchronization message from the master head. If a synchronization message is not received, the slave head stops stitching and broadcasts a stop command, as noted by blocks 992 and 996. If the slave head does receive a synchronization message from the master head, it compares a stitch number that is transmitted with the synchronization message to the current stitch number of the slave head, as noted by block 1004. The slave head then determines whether the stitch numbers match, as noted by block 1008. If the stitch numbers do match, the slave head determines if it has reached the last stitch, as indicated by block 1012. If the stitch is the last stitch, the slave head stops stitching, as indicated by block 1016. If the stitch is not the last stitch, the slave head continues operations as described with respect to blocks 968 through 1012.

If at block 1008, the slave head determines that the stitch numbers do not match, it determines the amount of mismatch at block 1020. In this embodiment, the slave head must maintain a −3/+0 stitch difference with the master head. That is, the slave head must be no more than three stitches behind the master head, and no greater than zero stitches ahead of the master head. If the difference is within the predetermined amount of stitches, the slave head adjusts its stitching speed according to a predefined control scheme, as noted by block 1024. The stitching machine then performs the operation as described above with respect to blocks 1012, and the operations that followed. If at block 1020, the slave head determines that it is not within the predetermined number of stitches of the master head, it stops stitching, as indicated by block 1028, and broadcasts a stop command to all of the devices in the cluster, as noted by block 1032.

Referring now to the flow chart illustration of FIG. 25, the operation of a master head during stitching operations is now described. Initially, as noted by block 1036, the master head receives a design from the host (controller). The master head determines whether its start button has been depressed, as noted by block 1040. If the master head's start button is not depressed, the master head determines if it has received a start command from a slave head, at noted by block 1044. If no start command has been received, the master head continues the operations associated with blocks 1040–1044. Once the master head's start button is depressed, or the master head receives a start command from a slave head, the master head broadcasts a job synchronization command to all of the devices in the cluster, as noted by block 1048. The contents of the job synchronization command are as described above. The master head then waits for synchronization acknowledgment from each slave head, as noted by block 1052. In response to the job synchronization command, a slave head may send an error in response to the job synchronization command, which may indicate an error in the machine or an error in the downloaded design. When the master head receives each synchronization acknowledgment, it verifies that the acknowledgment is valid, or contains an error, and determines if a valid acknowledgment is received from each head, as noted by block 1056. If a valid acknowledgment is not received from each head, the master head sends a notification indicating the error to the host, as noted by block 1058. If the master head does receive a valid acknowledgment from each head, it broadcasts a heartbeat message to all of the devices in the cluster, as noted by block 1060. In one embodiment, a heartbeat message is sent every 250 milliseconds. At block 1062, the master head broadcasts a start command and begins stitching operations. During stitching operations, the master head monitors itself for stitching errors, as noted by block 1064. If there is a stitching error, the master head stops stitching, noted by block 1066, and broadcasts a stop command to all of the devices in the cluster, as noted by block 1068. The master head, at block 1072, determines if a stop command has been received from any device in the cluster. If the master head does receive a stop command, it stops stitching, as noted by block 1076, and broadcasts a stop command to all of the devices in the cluster, as noted by block 1078. The master head, at block 1080, broadcasts a synchronization message to all of the slave heads. In one embodiment, the synchronization message includes the current stitch count for the master head. The master head, at block 1084, verifies that each slave head is sending heartbeat messages periodically. If a slave head heartbeat is missing, the master head, at block 1088, stops stitching, and broadcasts a stop command to all of the devices in the cluster, as noted by block 1092. The master head determines if it has reached the last stitch in the design, as noted by block 1096. If the last stitch has not been completed, the master head repeats the operations associated with blocks 1064 through 1096. If the last stitch has been completed, the master head stops stitching, as noted by block 1100.

As described above, embroidery machines in a cluster are synchronized through communications between the embroidery machines in the cluster. This allows the ability to place two or more embroidery machines directly adjacent to one another with little risk of the hoops on the machines colliding. For example, a first embroidery machine and a second embroidery machine may be placed relatively close to one another. During stitching operations, if the first and second embroidery machines are not synchronized, the hoops moved by X-Y carriages on their respective machines may collide. That is, the hoop on the first embroidery machine may be in such a position that the far edge of the hoop is relatively close to the second embroidery machine. Likewise, the hoop on the second embroidery machine may be in such a position that the far edge of the hoop is relatively close to the first embroidery machine. If the embroidery machines are positioned relatively close to one another, such a situation results in collision of the two hoops, potentially causing damage to the embroidery machines. However, when the two embroidery machines are conducting the same operations substantially simultaneously as described above, they may be placed in close proximity to one another without a substantial risk of the hoops colliding. Accordingly, embroidery machines which employ the software synchronization as described above may be located closer to one another than non-synchronized machines, thus reducing the overall footprint of such a cluster of machines compared to the footprint of a non-synchronized cluster of machines.

It should be appreciated that other designs, systems or architectures could be utilized to implement the network of stitching machines that are able to substantially simultaneously stitch the same pattern. By way of example, the control involved may include a number of controllers or a single controller, such as where the functions of the controller are accomplished by the same controller or controllers that control the simultaneous stitching operations. Additionally, other stitching machines than the embroidery machines of FIG. 1 could be employed in the network to perform the same operations and achieve the same objectives. Similarly, with respect to the stitching apparatus of FIGS. 1–20, other designs or embodiments could be provided to implement and/or control the desired functions. Instead of a host controller, main controller and thread sensor controller, a control could be provided that has more or fewer than these three controllers. For example, all or some of the functions accomplished by the thread sensor controller could be done by the main controller. In another example, all necessary control and fictions could be implemented by a single controller.

The foregoing discussion of the invention has been presented for purposes of illustration and description. Further, the description is not intended to limit the invention to the form disclosed herein. Consequently, variations and modifications commensurate with the above teachings, within the skill and knowledge of the relevant art, are within the scope of the present invention. The embodiments described hereinabove are further intended to explain the best modes presently known of practicing the inventions and to enable others skilled in the art to utilize the inventions in such, or in other embodiments, and with the various modifications required by their particular application or uses of the invention. It is intended that the appended claims be construed to include alternative embodiments to the extent permitted by the prior art.

What is claimed is:

1. A method for stitching using a stitching apparatus, comprising:

providing a plurality of active thread feeders including at least first and second active thread feeders, wherein each of said active thread feeders includes a driven roller and a pinch roller;

causing activation of said first active thread feeder to stitching a first stitch; and discontinuing activation of said first active thread feeder during a stitching cycle associated with said first stitch.

2. A method, as claimed in claim 1, further including:

moving said first active thread feeder relative to a motor that is used in conducting said causing step.

3. A method for stitching using a stitching apparatus, comprising:

providing a plurality of active thread feeders including at least first and second active thread feeders;

causing activation of said first active thread feeder related to stitching a first stitch;

discontinuing activation of said first active thread feeder during a stitching cycle associated with first stitch;

moving said first active thread feeder relative to a motor that is used in conducting said causing step; and locating said first active thread feeder away from said motor and positioning said second active thread feeder for activation thereof using said motor.

4. A method for stitching using a stitching apparatus, comprising:

providing a plurality of active thread feeders including a first active thread feeder and a second active thread feeder and a motor that selectively causes activation of one of said first and second active thread feeders, wherein each of said active thread feeders includes a driven roller and a pinch roller;

positioning said first active thread feeder relative to said motor;

causing activation of said first active thread feeder;

moving said second active thread feeder relative to said motor; and causing activation of said second active thread feeder using said motor.

5. A method, as claimed in claim 4, wherein:

said causing activation of said first active thread feeder includes stitching at least a first stitch during a first stitching cycle and discontinuing said causing step at least during some time during said first stitching cycle.

6. A thread feed assembly in a stitching apparatus, comprising:

a plurality of active thread feeders mounted to a needle case including first and second active thread feeders, at least said first active thread feeder being used in delivering a first thread from a first spool to a needle; and a motor that drives said first active thread feeder when said needle case is in a first location and that drives said second active thread feeder when said needle case is in a second location.

7. An assembly, as claimed in claim 6, wherein:

said first active thread feeder moves relative to said motor.

8. An assembly, as claimed in claim 6, wherein:

said first active thread feeder includes at least a first gear and at least a first roller.

9. An assembly, as claimed in claim 6, wherein:

said first active thread feeder includes at least a first gear and an aligner contacts said first gear in aligning said first gear in operative association with said motor.

10. An assembly, as claimed in claim 9, wherein:

said motor is operably associated with a motor gear that causes said first gear to rotate when said motor is activated.

* * * * *

UNITED STATES PATENT AND TRADEMARK OFFICE

CERTIFICATE OF CORRECTION

PATENT NO. : 6,871,605 B1
DATED : March 29, 2005
INVENTOR(S) : Manfred Zesch

It is certified that error appears in the above-identified patent and that said Letters Patent is hereby corrected as shown below:

Column 26,
Line 52, after "feeder," insert -- related --;
Line 67, after "with," insert -- said --;

Signed and Sealed this

Thirty-first Day of May, 2005

JON W. DUDAS
*Director of the United States Patent and Trademark Office*